US007258293B2

(12) United States Patent
Tanaka et al.

(10) Patent No.: US 7,258,293 B2
(45) Date of Patent: Aug. 21, 2007

(54) WOOD CRUSHER AND WOOD TREATING METHOD

(75) Inventors: Masamichi Tanaka, Tsukuba (JP); Masanori Shinooka, Ibaraki-ken (JP); Kazuhide Seki, Tsukuba (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 195 days.

(21) Appl. No.: 11/062,853

(22) Filed: Feb. 23, 2005

(65) Prior Publication Data

US 2005/0194478 A1 Sep. 8, 2005

(30) Foreign Application Priority Data

Feb. 24, 2004 (JP) ..... 2004-048770

(51) Int. Cl.
*B02C 19/00* (2006.01)

(52) U.S. Cl. ..... 241/186.35; 241/28; 241/223

(58) Field of Classification Search ..... 241/223, 241/186.35, 28
See application file for complete search history.

(56) References Cited

U.S. PATENT DOCUMENTS 5,947,395 A 9/1999 Peterson et al.
6,299,082 B1 10/2001 Smith

FOREIGN PATENT DOCUMENTS

JP 2002-1159 1/2002

OTHER PUBLICATIONS

European Search Report dated Jun. 28, 2005.

*Primary Examiner*—Mark Rosenbaum
(74) *Attorney, Agent, or Firm*—Mattingly, Stanger, Malur & Brundidge

(57) ABSTRACT

A wood crusher has body frame; a crushing apparatus installed on the body frame and a crushing rotor rotated in a crushing chamber. A feed conveyor for conveying wood to be crushed is installed on one side of the body frame in the longitudinal direction thereof and includes a drive wheel, a driven wheel, and a running member looped between the drive wheel and the driven wheel. A bottom-equipped hopper having side walls on both sides of the feed conveyor in the transverse direction thereof, and a bottom wall disposed under the feed conveyor has a guide member disposed in continuation with the bottom wall of the hopper at a position near the drive wheel of the feed conveyor to prevent wood pieces from accumulating near the drive wheel. This arrangement prevents the wood pieces from being dropped onto the ground during the crushing work.

6 Claims, 16 Drawing Sheets

WOOD CRUSHER AND WOOD TREATING METHOD

BACKGROUND OF THE INVENTION

1. Field of the Invention

The present invention relates to a wood crusher for crushing cut limbs, timbers from thinning, branches, scrap woods, and so on. More particularly, the present invention relates to a wood crusher in which, for example, a crushing rotor is rotated to crush target woods, and also relates to a wood treating method.

2. Description of the Related Art

For example, cut limbs and timbers from thinning, which are generated when cutting down trees in forests and trimming the trees, branches generated with land development, green tract maintenance, etc., and scrap woods having been used in broken-down wooden houses are usually finally discarded as industrial wastes. A wood crusher is employed in such a waste treating process to crush target woods into predetermined sizes for the purpose of, e.g., reducing the volume of the crushed woods as wastes, or breaking the crushed woods into wood chips and fermenting the chips for reuse as organic fertilizer.

In one typical example of that type of wood crusher, target woods to be crushed are loaded in a hopper having no bottom and are conveyed by a feed conveyor disposed inside the hopper and having a chain belt to feed the target woods. Then, the target woods are introduced to a crushing apparatus and subjected to a crushing process while they are gripped between the feed conveyor and a pressing roller unit cooperating with the feed conveyor at a position in front of the crushing apparatus. (See, e.g., JP,A 2002-1159)

SUMMARY OF THE INVENTION

In the related art described above, the loaded target woods are conveyed and introduced to the crushing apparatus by an endless chain belt. The chain belt having moved on a conveying plane is turned downward round a drive wheel positioned in front of the crushing apparatus and is returned toward a driven wheel. At that time, some of wood pieces (chips), etc. conveyed over the conveying surface of the chain belt are sometimes not introduced to the crushing apparatus and are entrained to the return run side with rotation of the drive wheel while being caught on the chain belt. In such a case, there is a possibility that, when the wood pieces, etc. are released from the chain belt during the movement for return to the driven wheel, they are dropped onto the ground and accumulated or scattered under the feed conveyor with the lapse of work time because the hopper has no bottom.

In view of the above-described situation, the inventors have previously invented the structure of a bottom-equipped hopper comprising side walls disposed on both sides of the feed conveyor in the transverse direction and a bottom wall disposed under the feed conveyor. By using the bottom-equipped hopper, even when some of the wood pieces, etc. are caught on the chain belt and entrained to the return run side during the crushing work, the wood pieces, etc. can be prevented from being scattered under the feed conveyor because they are blocked by and received on the bottom wall of the hopper.

However, the provision of the bottom wall of the hopper may cause a trouble that the wood pieces, etc. having been entrained to the return run side are accumulated on the bottom wall and impede the smooth operation of the feed conveyor. In particular, when the wood pieces, etc. accumulated on the bottom wall are concentrated near the drive wheel or the driven wheel, the accumulated wood pieces may stop driving of the feed conveyor in the worst case.

In view of the problems set forth above, it is an object of the present invention to provide a wood crusher and a wood treating method, which can prevent wood pieces from dropping onto the ground during the crushing work and can ensure the smooth operation state of a feed conveyor.

To achieve the above object, according to a first aspect of the present invention, a wood crusher comprises a body frame; a crushing apparatus installed on the body frame and including a crushing rotor rotated in a crushing chamber; a feed conveyor installed on one side of the body frame in the longitudinal direction thereof and including a drive wheel, a driven wheel, and a running member looped between the drive wheel and the driven wheel, thereby conveying woods to be crushed to the crushing apparatus; a bottom-equipped hopper having side walls on both sides of the feed conveyor in the transverse direction thereof, and a bottom wall disposed under the feed conveyor; and a guide member disposed in continuation with the bottom wall of the hopper at a position near the drive wheel of the feed conveyor to prevent wood pieces from accumulating near the drive wheel.

According to a second aspect of the present invention, a wood crusher comprises a body frame; a crushing apparatus installed on the body frame and including a crushing rotor rotated in a crushing chamber; a feed conveyor installed on one side of the body frame in the longitudinal direction thereof and including a drive wheel, a driven wheel, and a running member looped between the drive wheel and the driven wheel, thereby conveying woods to be crushed to the crushing apparatus; a bottom-equipped hopper having side walls disposed on both sides of the feed conveyor in the transverse direction thereof, and a bottom wall disposed under the feed conveyor; and a guide member disposed in continuation with the bottom wall of the hopper at a position near the driven wheel of the feed conveyor to prevent wood pieces from accumulating near the driven wheel and to promote return of the wood pieces onto a conveying surface of the feed conveyor.

According to a third aspect of the present invention, in the wood crusher according to the first or second aspect of the present invention, the guide member is formed substantially in a circular-arc shape to extend in proximity to a locus along which the drive wheel or the driven wheel of the feed conveyor is rotated.

According to a fourth aspect of the present invention, in the wood crusher according to the second aspect of the present invention, the guide member is slidable together with the driven wheel of the feed conveyor in the direction in which the woods to be crushed are conveyed by the feed conveyor.

According to a fifth aspect of the present invention, in the wood crusher according to the first aspect of the present invention, the hopper has a front wall disposed forward of the feed conveyor and an opening formed in the front wall to be communicated with the crushing chamber,.and the guide member is disposed to extend from the bottom wall of the hopper toward the opening formed in the front wall.

According to a sixth aspect of the present invention, in the wood crusher according to the first or second aspect of the present invention, the hopper is provided in a rear end portion thereof with an opening/closing section to which the guide member is attached.

According to a seventh aspect of the present invention, in a wood treating method comprising the steps of loading woods to be crushed in a bottom-equipped hopper installed on one side of a body frame in the longitudinal direction thereof; and conveying the woods toward a crushing apparatus by a feed conveyor installed in the hopper, thereby crushing the woods, the method further comprises the step of driving the feed conveyor backward to introduce wood pieces, which have been accumulated in the hopper without being introduced to the crushing apparatus, to the crushing apparatus to be subjected to a crushing process through an opening formed in a front wall of the hopper while guiding the accumulated wood pieces by a guide member disposed near a drive wheel on the front side of the feed conveyor.

DESCRIPTION OF THE PREFERRED EMBODIMENTS

Embodiments of a wood crusher according to the present invention will be described below with reference to the drawings.

Figure 1:
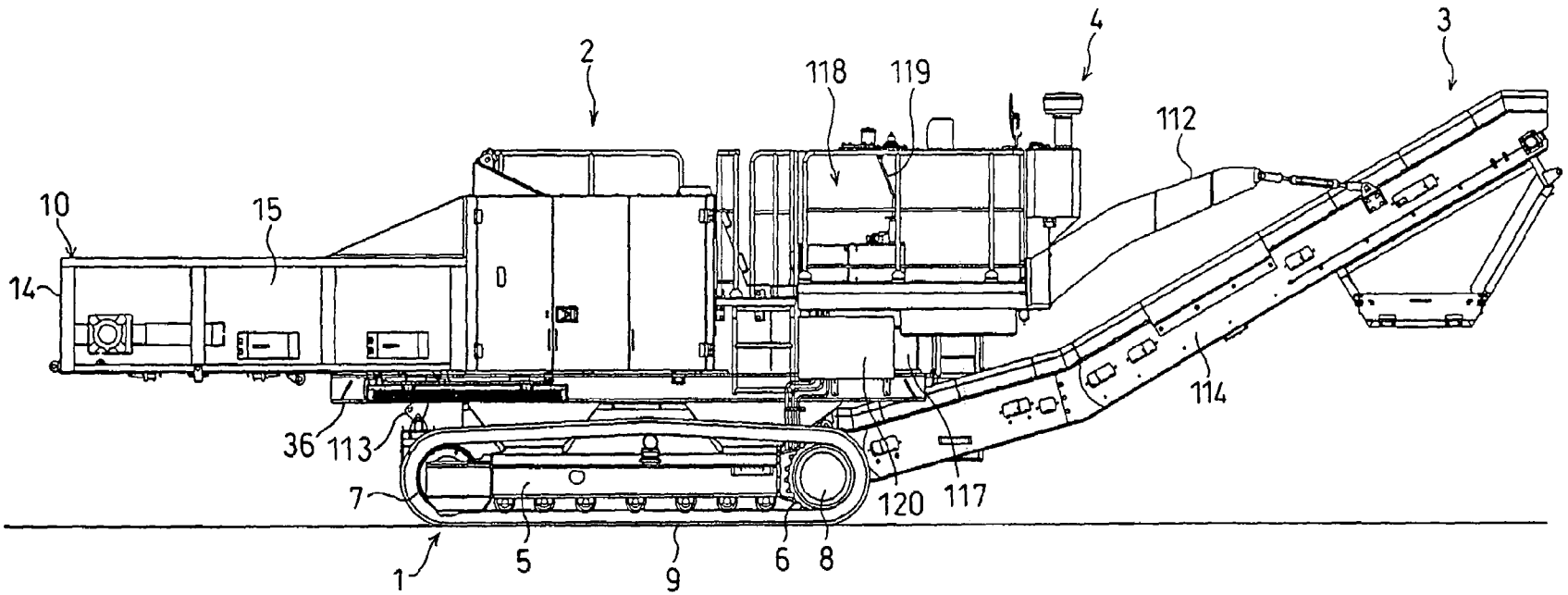
FIG. 1 is a side view showing an overall structure of a wood crusher according to one embodiment of the present invention.
Figure 2:
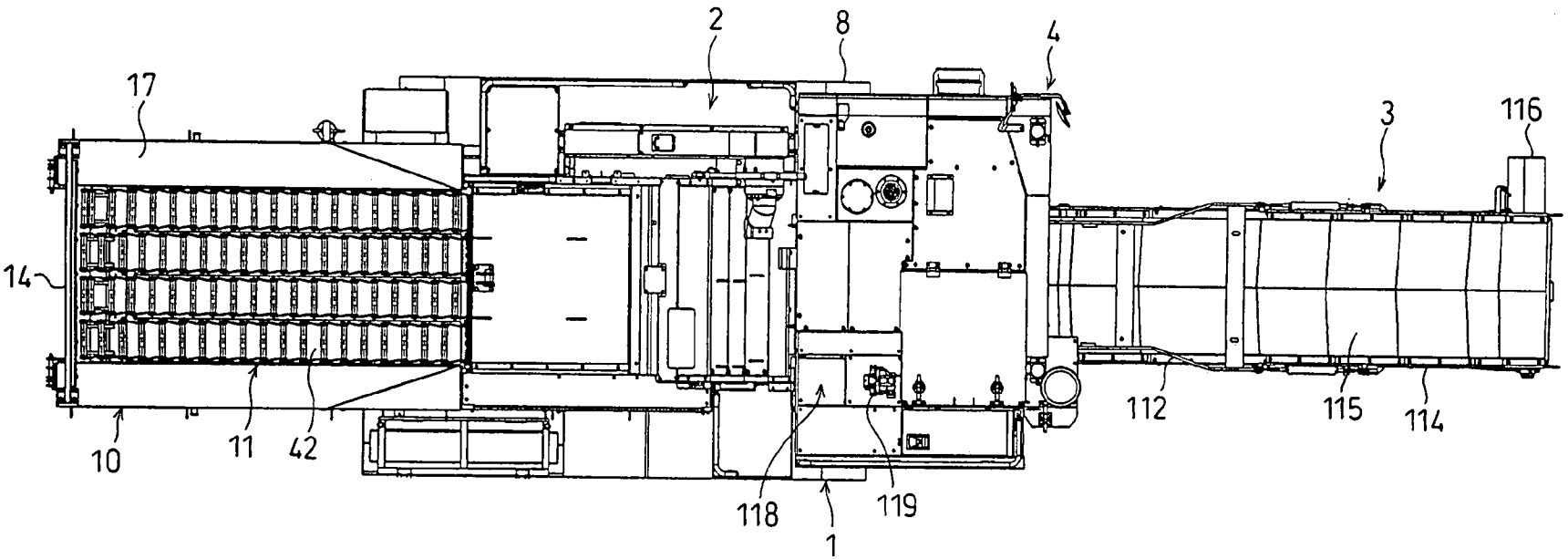
FIG. 2 is a plan view showing the overall structure of the wood crusher according to one embodiment of the present invention.
Figure 3:
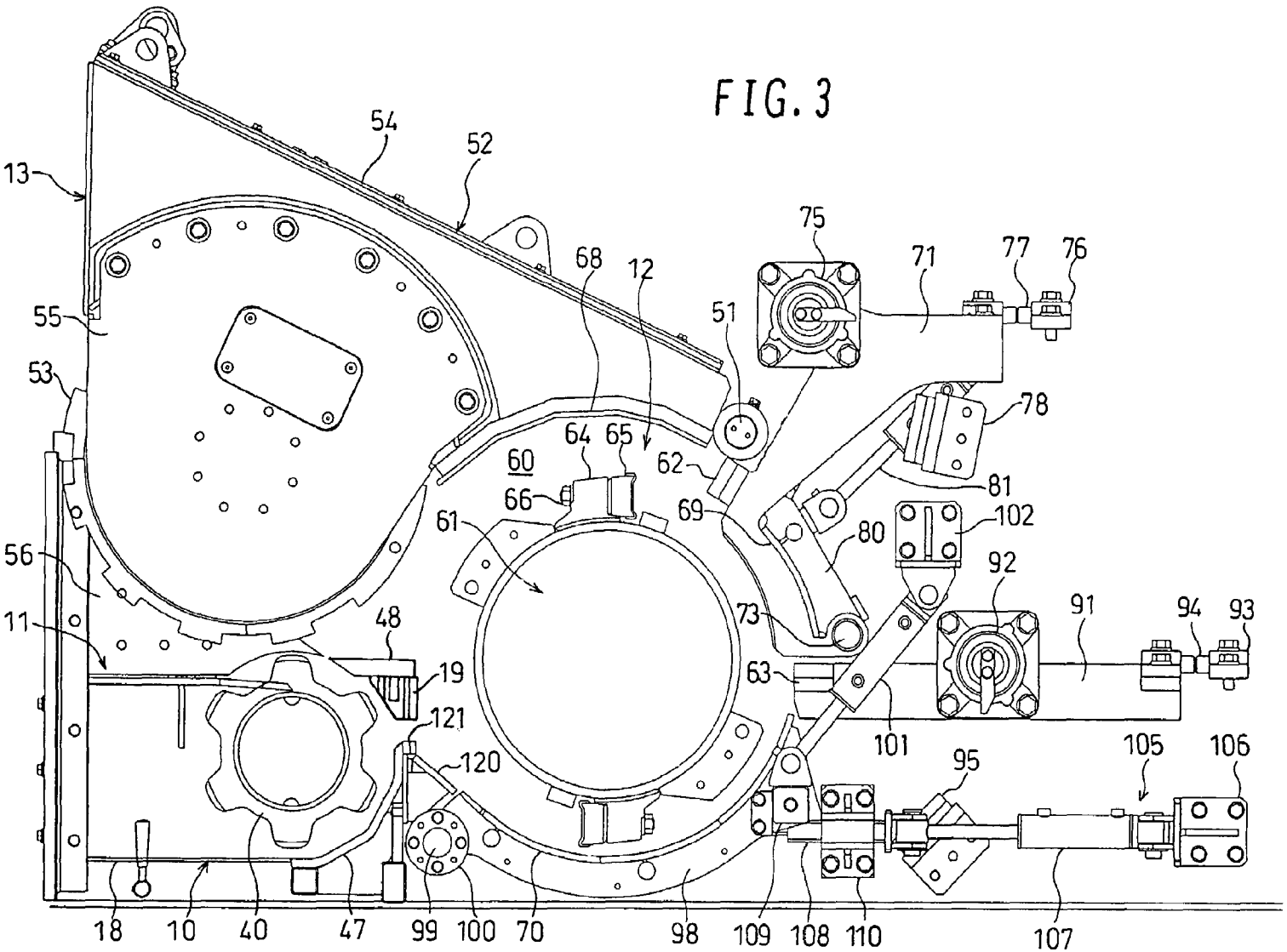
FIG. 3 is a side view showing a detailed structure within side covers in the vicinity of a crushing apparatus provided in the wood crusher according to one embodiment of the present invention.

FIG. 1 is a side view showing an overall structure of a wood crusher according to one embodiment of the present invention, FIG. 2 is a plan view of the wood crusher, shown in FIG. 1, according to one embodiment of the present invention, and FIG. 3 is a side view showing a detailed structure within side covers in the vicinity of a crushing apparatus 12 described later. Note that, in the following description, directions corresponding to the left and right in FIG. 1 are assumed to represent respectively the rear and front of the wood crusher or one side and the other side thereof.

Referring to FIGS. 1 to 3, reference numeral 1 denotes a travel body capable of self-propelling, and 2 denotes a crushing function structure installed on the travel body 1 and crushing loaded target woods to be crushed. Numeral 3 denotes a discharge conveyor for conveying the woods having been crushed by the crushing function structure 2 and discharging the crushed woods to the exterior of the crusher, and 4 denotes a power unit including a power source (engine), etc. for various components mounted in the crusher. The wood crusher of this embodiment comprises primarily the travel body 1, the crushing function structure 2, the discharge conveyor 3, the power unit 4, etc.

The travel body 1 comprises a track frame 5, a drive wheel 6 and a driven wheel 7 disposed respectively at longitudinal opposite ends of the track frame 5, a driving unit (i.e., hydraulic motor for travel) 8 having an output shaft coupled to a shaft of the drive wheel 6, and a crawler (caterpillar belt) 9 looped over the drive wheel 6 and the driven wheel 7. Numeral 36 denotes a body frame disposed on the track frame 5. The body frame 36 supports the crushing function structure 2, the discharge conveyor 3, the power unit 4, etc.

The crushing function structure 2 comprises a hopper 10 for receiving the loaded target woods, a feed conveyor 11 serving as feed means that is installed on one side of the body frame 36 in the longitudinal direction (i.e., on the left side as viewed in FIG. 1) and feeds the target woods loaded into the hopper 10, a crushing apparatus 12 (see also FIG. 3, etc.) installed on the body frame 36 and crushing the target woods introduced by the feed conveyor 11, and a pressing conveyor unit 13 (see also FIG. 3, etc.) for pressing the target woods, which is going to be introduced to the crushing apparatus 12, against the feed conveyor 11 at a position in front of the crushing apparatus 12.

Figure 4:
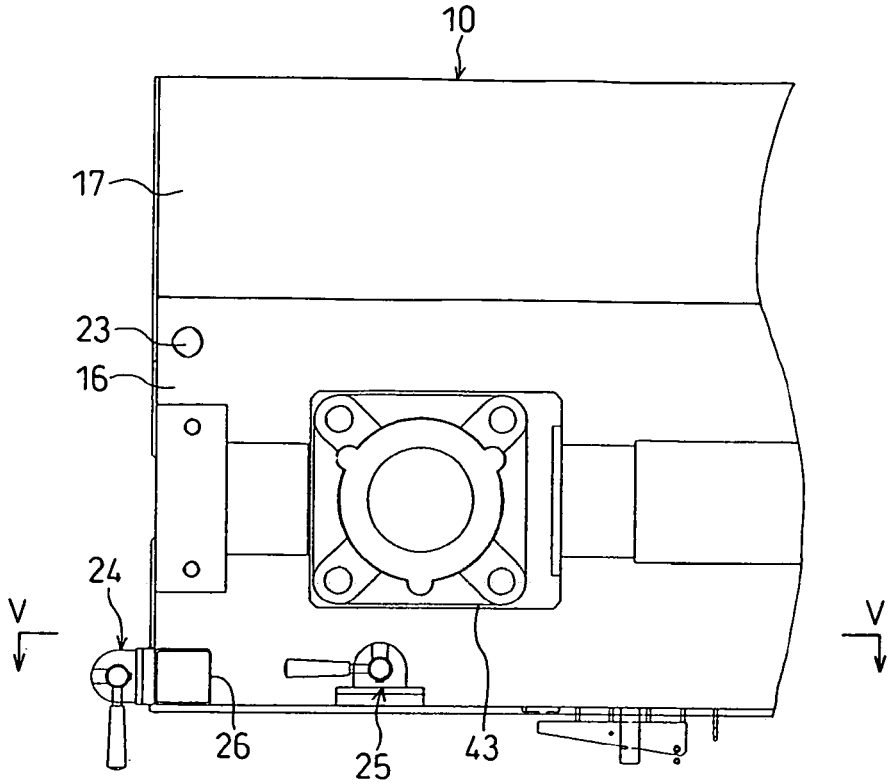
FIG. 4 is a side view showing a detailed structure in the vicinity of a rear end of a hopper provided in the wood crusher according to one embodiment of the present invention.
Figure 5:
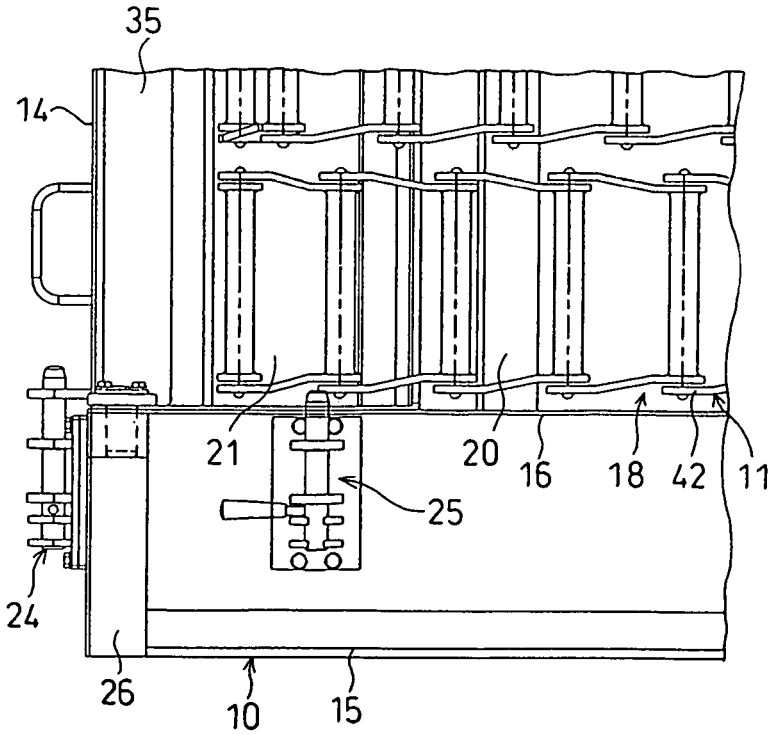
FIG. 5 is a sectional view taken along the line V-V in FIG. 4 and looking in the direction of an arrow, the view showing a detailed structure in the vicinity of the rear end of the hopper provided in the wood crusher according to one embodiment of the present invention.
Figure 6:
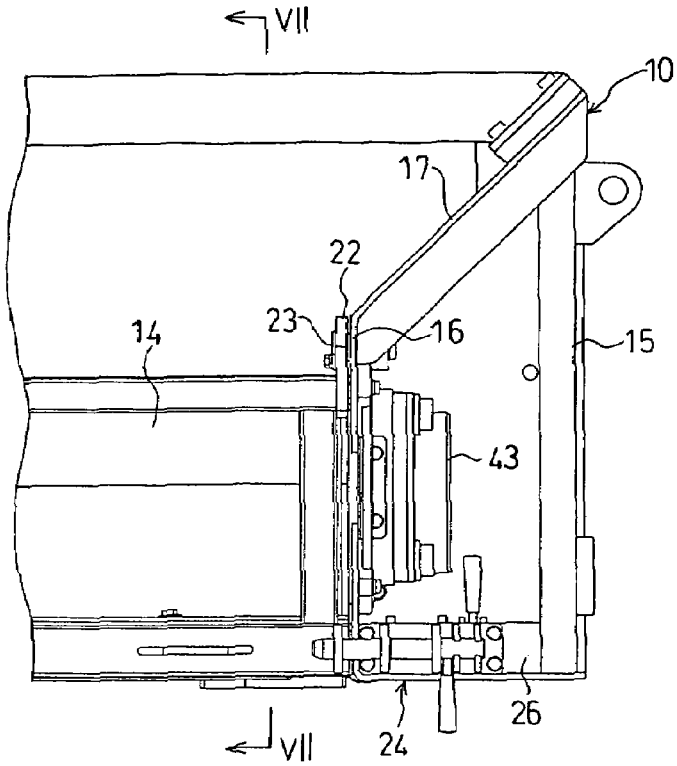
FIG. 6 is a direct rear view looking from the rear of the hopper, the view showing a detailed structure in the vicinity of the rear end of the hopper provided in the wood crusher according to one embodiment of the present invention.

FIG. 4 is a side view showing a detailed structure in the vicinity of a rear end of the hopper 10, FIG. 5 is a sectional view taken along the line V-V in FIG. 4 and looking in the direction of an arrow, and FIG. 6 is a direct rear view of the hopper 10 looking from the rear thereof. Similar components in FIGS. 4 through 6 to those in the above-described drawings are denoted by the same symbols and a description of those components is omitted here. Note that FIG. 4 shows a state where an outer wall 15, described later, is removed.

Referring to FIGS. 4 through 6, the hopper 10 is in the bottom-equipped form and is extended to lie substantially horizontally on the rear side of a crushing rotor 61 (described later) installed on the body frame 36. The hopper 10 comprises a rear wall 14 disposed behind the feed conveyor 11, outer walls 15 disposed on both sides in the transverse direction of the feed conveyor 11, L-shaped side walls 16 each made up of plural members and disposed inside the outer walls 15 on both sides in the transverse direction of the feed conveyor 11 while leaving gaps relative to the outer walls 15, a spreading (flaring) portion 17 provided above the outer walls 15 and the side walls 16 so as to straddle between them and to gradually spread upward, a bottom wall 18 formed to extend over an entire bottom surface and positioned under the feed conveyor 11 while leaving a slight gap relative to the feed conveyor 11, and a front wall 19 disposed at a front end. An upper end of the rear wall 14 is set flush with or slightly higher than a conveying surface of the feed conveyor 11, and an upper end of the front wall 19 is set slightly lower than the conveying surface of the feed conveyor 11.

Figure 7:
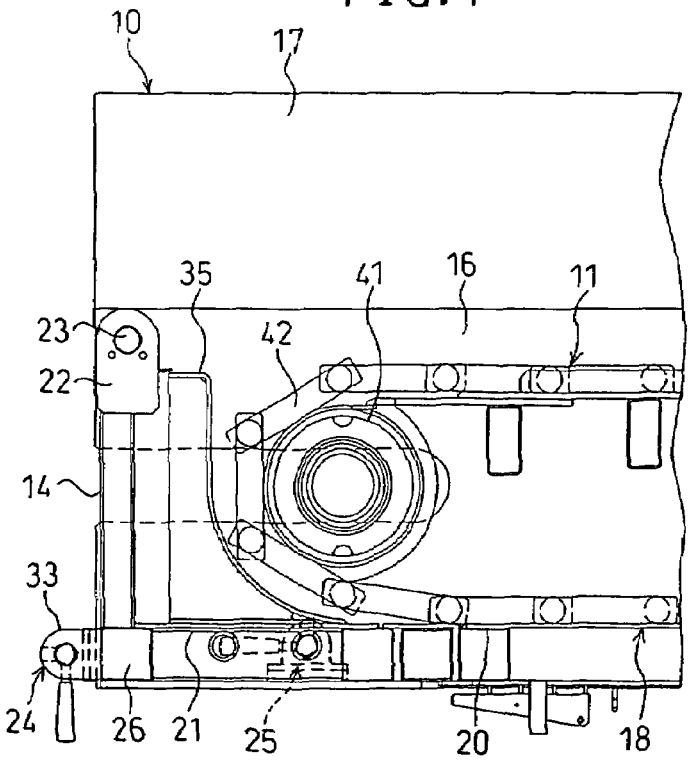
FIG. 7 is a sectional view taken along the line VII-VII in FIG. 6 and looking in the direction of an arrow, the view showing a detailed structure of a rear end portion of a feed conveyor provided in the wood crusher according to one embodiment of the present invention.

FIG. 7 is a sectional view taken along the line VII-VII in FIG. 6 and looking in the direction of an arrow, the view showing a detailed structure of a rear end portion of the feed conveyor 11. Similar components in FIG. 7 to those in the above-described drawings are denoted by the same symbols and a description of those components is omitted here.

In this embodiment, the bottom wall 18 of the hopper 10 is divided into a stationary section 20 and an opening/closing section 21 that is positioned at the rear end of the hopper 10. The stationary section 20 is fixed to the side walls 16, while the opening/closing section 21 is fixed to the rear wall 14. An upper end portion of the rear wall 14 has a pin 23 attached to it through a bracket 22, and the rear wall 14 is mounted to the side walls 16 such that it is rotatable about the pin 23 serving as a fulcrum. With such an arrangement, the opening/closing section 21 fixed to the rear wall 14 is rotated together with the rear wall 14, and hence a rear end portion of the bottom wall 18 can be opened and closed as required. A guide member 35 is mounted on the opening/closing section 21 and is formed substantially in a circular-arc shape so as to extend in proximity to a locus along which a rear end of the feed conveyor 11 (or a driven wheel 41 described later) turns around (or is rotated), thereby preventing the loaded target woods from entering a space behind the feed conveyor 11. Further, the guide member 35 disposed in continuation with the bottom wall 18 of the hopper 10 in a position near the driven wheel 41 of the feed conveyor 11 serves not only to prevent some of the crushed woods (wood pieces), etc., which have been entrained to the return run side of the feed conveyor 11, from accumulating near the driven wheel 41, but also to urge the entrained wood pieces for return onto the conveying surface of the feed conveyor 11 again.

Numerals 24, 25 denote locking mechanisms that serve to hold the opening/closing section 21 in a closed state. The locking mechanism 24 is provided on a rear end surface of a beam 26 extending between rear ends of bottom portions of the L-shaped side walls 16, and the locking mechanism 25 is provided on an upper surface of the bottom portion of each side wall 16 at a position slightly shifted forward from the locking mechanism 24.

Figure 8A:
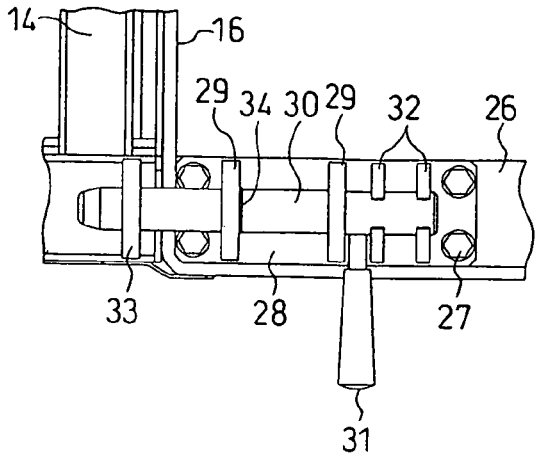
FIGS. 8A and 8B are each a view showing in detail a mechanism for locking an opening/closing section of the hopper provided in the wood crusher according to one embodiment of the present invention.
Figure 8B:
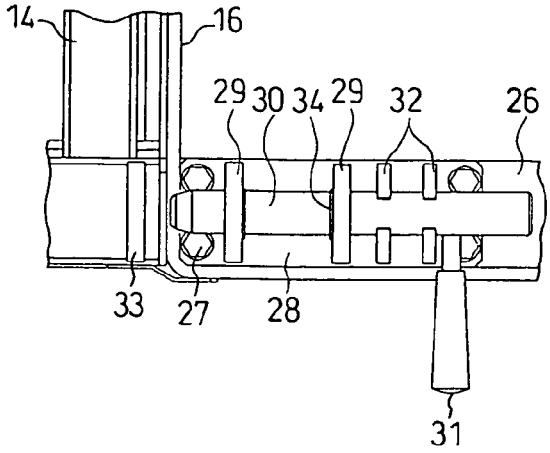

FIGS. 8A and 8B are each a view showing the locking mechanism 24 in detail, the view being looked in the same direction as that in FIG. 6. Similar components in FIGS. 8A and 8B to those in the above-described drawings are denoted by the same symbols and a description of those components is omitted here. Note that, though not described in detail, the locking mechanism 25 is similarly constructed to the locking mechanism 24.

Referring to FIGS. 8A and 8B, the locking mechanism 24 comprises a support plate 28 fixed to the beam 26 by a plurality of bolts 27, two brackets 29 provided on the support plate 28 at a predetermined spacing between them, a pin 30 penetrating the brackets 29, a handle 31 projecting from an outer periphery of the pin 30 substantially at a right angle, a latch member 32 for latching the handle 31 in place, and a bracket 33 fixed to a lower end of the rear wall 14.

Figure 9:
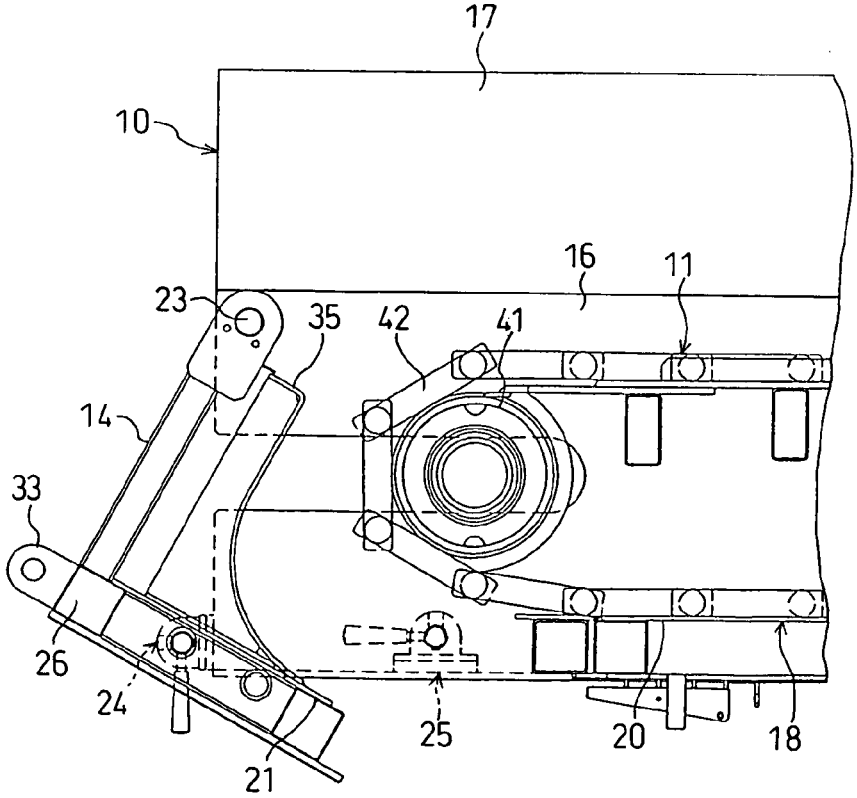
FIG. 9 is a view showing an open state of the opening/closing section of the hopper provided in the wood crusher according to one embodiment of the present invention.

With such a structure, as shown in FIG. 8A, when the pin 30 is inserted through the bracket 33 on the rear wall 14 side and the handle 31 is latched between the bracket 29 and the latch member 32, the rear wall 14 is secured to the side wall 16 through the pin 30 and the opening/closing section 21 of the bottom wall 18 is held in the closed state. On the other hand, when the handle 31 is rotated together with the pin 30 to take a substantially horizontal position and is slid together with the pin 30 while passing through a cut portion of the latch member 32 to such an extent that the pin 30 is withdrawn from the bracket 33 as shown in FIG. 8B, the rear wall 14 is released from state restricted to the side wall 16. In this embodiment, there is another locking mechanism 25. By withdrawing a pin of the locking mechanism 25 from a bracket provided on the opening/closing section 21 side in a similar way, therefore, the opening/closing section 21 is completely released from the restricted state so that the opening/closing section 21 can be opened. The open state of the opening/closing section 21 is shown in FIG. 9 that corresponds to FIG. 7. When the wood pieces are accumulated below the feed conveyor 11 in the hopper 10, the following advantage is obtained by driving the feed conveyor 11 with the opening/closing section 21 kept in the open state. The wood pieces accumulated on the bottom wall 18 are carried with running members 42 (described later) of the feed conveyor 11 on the return run side such that they can be easily discharged during maintenance, for example.

Additionally, numeral 34 denotes a snap ring for preventing slipping-off of the pin 30. The snap ring 34 is fitted over the outer periphery of the pin 30 to be located between the two brackets 29, 29. In this embodiment, the snap ring 34 is disposed at such a position as causing it to abut against the inner and outer brackets 29 in the locked state shown in FIG. 8A and the unlocked state shown in FIG. 8B, respectively, whereby the stroke of the pin 30 is limited to a proper length.

The feed conveyor 11 comprises a sprocket-like drive wheel 40 (see FIG. 3) disposed on the side close to a crushing rotor 61 (described later), a driven wheel 41 (see FIG. 7, etc.) disposed on the opposite side (i.e., on the rear side of the wood crusher or the side close to the rear wall 14), and running members 42 (i.e., conveyor belts or chain belts) 42 looped between the drive wheel 40 and the driven wheel 41 at opposite ends of the feed conveyor 11 in the feed direction and disposed in plural rows (four in this embodiment, see FIG. 2) side by side in the transverse direction. Note that, for the sake of simplicity, the conveyor running members 42 are not shown in FIG. 3 described above and FIGS. 11 and 17 described later.

The driven wheel 41 is supported by a bearing 43 (see FIG. 4) mounted to an outer wall surface of the side wall 16 of the hopper 10 in a rear portion of the side wall 16, and the drive wheel 40 is supported by a bearing 46 (described later, see FIG. 10) mounted to an outer wall surface of a side cover 45 (described later) of the crushing apparatus 12, the side cover 45 being provided forward of the side wall 16 so as to position substantially in flush with it. Thus, the feed conveyor 11 is disposed to substantially horizontally extend from a lower position inside the hopper 10, i.e., the inner side of the side wall 16 of the hopper 10, to a position near the crushing rotor 61 (described later) such that the feed conveyor 11 is entirely accommodated within the hopper 10 and the side cover 45 (described later) of the crushing apparatus 12.

Figure 10:
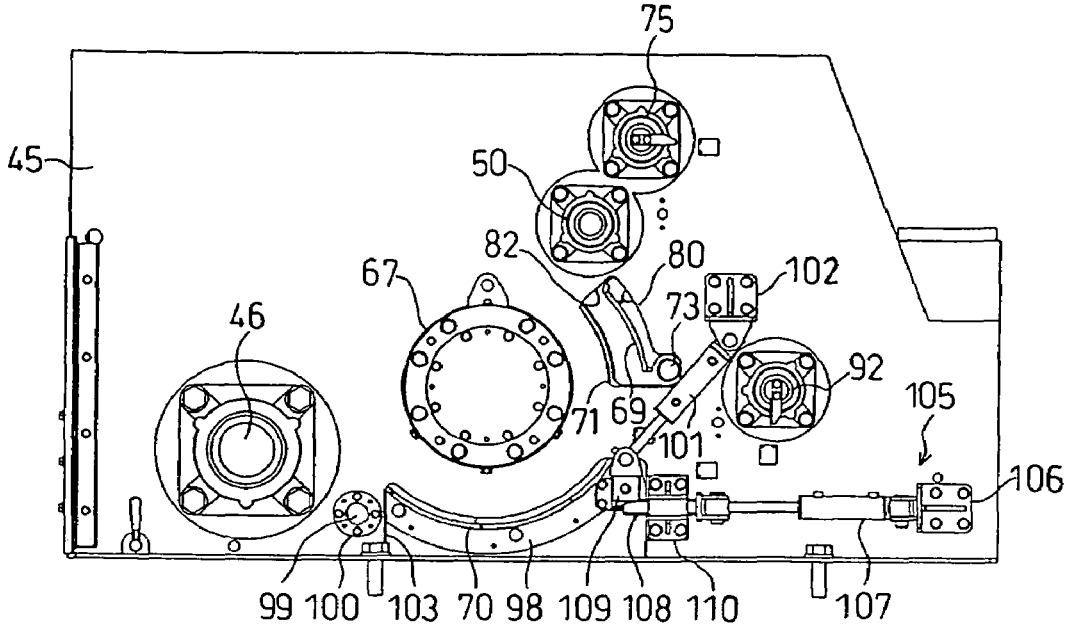
FIG. 10 is a side view in the vicinity of the crushing apparatus provided in the wood crusher according to one embodiment of the present invention.
Figure 11:
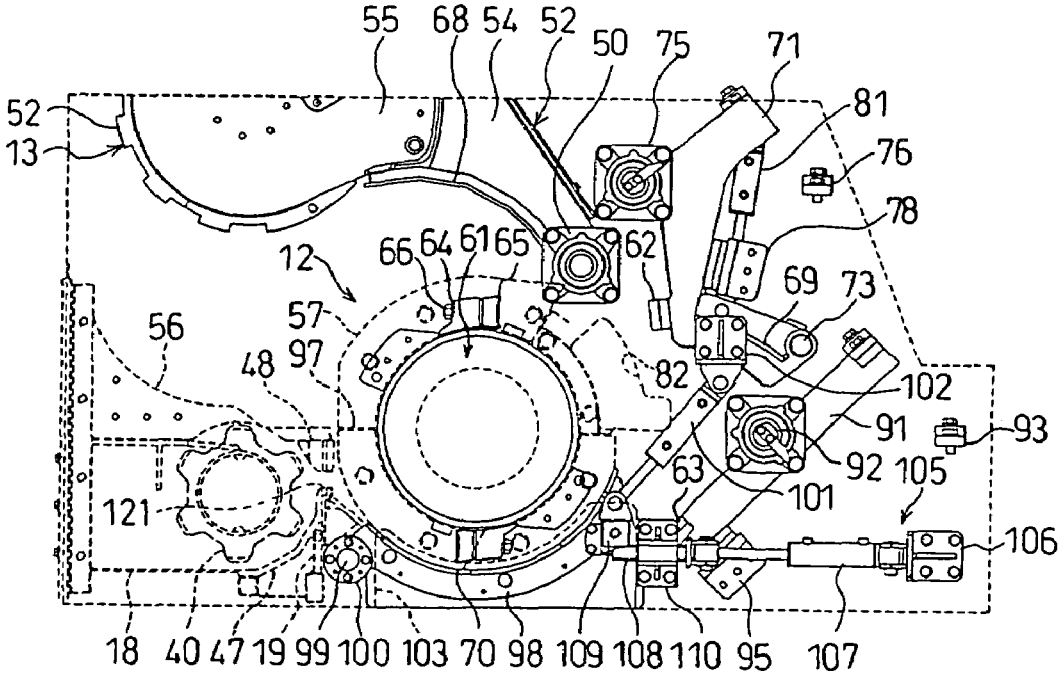
FIG. 11 is a sectional view showing a detailed internal structure in the vicinity of the crushing apparatus provided in the wood crusher according to one embodiment of the present invention.

FIG. 10 is a side view in the vicinity of the crushing apparatus 12, and FIG. 11 is a sectional view showing a detailed internal structure in the vicinity of the crushing apparatus 12. Similar components in FIGS. 10 and 11 to those in the above-described drawings are denoted by the same symbols and a description of those components is omitted here.

Referring to FIGS. 10 and 11, numeral 45 denotes a side cover of the crushing apparatus 12 installed forward of the hopper 10, and 46 denotes a bearing for the feed conveyor 11, which is mounted to an outer wall surface of the side cover 45. A rotary shaft of the drive wheel 40 of the feed conveyor 11 is coupled through, e.g., a coupling to an output shaft of a driving unit (i.e., a hydraulic motor for the feed conveyor, not shown) that is provided externally of the bearing 46 in the transverse direction. By rotating the not-shown driving unit, the feed conveyor 11 is driven to move the conveyor running members 42 between the drive wheel 40 and the driven wheel 41 in a circulating manner. Additionally, as shown in FIG. 11 (see also FIG. 3), the bottom wall 18 of the hopper 10 is extended to a position below the drive wheel 40 and has a fore end portion located inside the side cover 45.

Numeral 47 denotes a guide member that is disposed in continuation with the bottom wall 18 of the hopper 10 near the drive wheel 40 of the feed conveyor 11 and is formed substantially in a circular-arc shape so as to extend in proximity to a locus along which the drive wheel 40 is rotated. The guide member 47 is connected to the bottom wall 18 and the front wall 19 of the hopper 10, thereby preventing the wood pieces from being accumulated near the drive wheel 40. Numeral 48 denotes a scraper mounted to an upper portion of the front wall 19 at a position slightly lower than the top of the rotation locus of the drive wheel 40 such that a scraper end opposed to the drive wheel 40 is positioned as close as possible to the rotation locus of the drive wheel 40. Opposite ends of the guide member 47 and the scraper 48 in the transverse direction are fixed to the side cover 45 of the crushing apparatus 12.

The pressing conveyor unit 13 is provided adjacently rearward of the crushing rotor 61 (described later) in opposed relation to the conveying surface (upper run side) of the feed conveyor 11 over which the target woods to be crushed are conveyed. The pressing conveyor unit 13 comprises a support member 52 that has a rotary shaft 51 (see FIG. 3) journalled by the crusher side cover 45 through a bearing 50 (see FIG. 11) and is hence supported to be rotatable in a vertical plane (i.e., swingable up and down), and a pressing roller 53 provided rotatably relative to the support member 52.

The support member 52 comprises an arm portion 54 provided with the rotary shaft 51, and a bracket portion 55 provided on the distal end side of the arm portion 54 and supporting the pressing roller 53. A lower end surface of the arm portion 54 is formed to curve in a circular-arc shape, and a curved plate 68 constituting a part of a crushing chamber 60, described later, is attached to the lower curved surface of the arm portion 54. On the other hand, a mount area of the bracket portion 55 to which the pressing roller 53 is mounted is formed in a circular-arc shape having a smaller diameter than the pressing roller 53 such that an outer circumferential surface of the pressing roller 53 projects out of the bracket portion 55. The dimension of the pressing roller 53 in the transverse direction (i.e., in the direction perpendicular to the drawing sheet of FIG. 3) is set equal to or larger than the width of the conveying surface of the feed conveyor 11.

In FIGS. 3 and 11, numerals 56, 57 denote stoppers for limiting the rotating operation of the pressing conveyor unit 13. The stoppers 56, 57 are disposed inside the crusher side cover 45 such that, when the pressing roller 53 descends to a position near the drive wheel 40 of the feed conveyor 11, the bracket portion 55 and the curved plate 68 abut against the stoppers 56, 57, respectively. Though not specifically shown, the pressing roller 53 includes a driving unit (i.e., a hydraulic motor for the pressing roller) mounted within its barrel. The pressing roller 53 is rotated by the not-shown driving unit to advance in the same direction as the conveying surface of the feed conveyor 11 in an oppositely faced state substantially at the same circumferential speed as the conveying speed of the target woods, thereby pressing the target woods on the feed conveyor 11 and introducing them to the crushing apparatus 12 in cooperation with the feed conveyor 11.

The crushing apparatus 12 is mounted substantially on a central portion of the body frame 36 in the longitudinal direction. As shown in FIGS. 3 and 11, the crushing apparatus 12 comprises a crushing rotor 61 rotating in the crushing chamber 60 at a high speed, and a first anvil 62 and a second anvil 63 which are disposed opposite to the crushing rotor 61 in angularly spaced relation along the rotating direction (i.e., the forward rotating direction or the clockwise direction in FIG. 3) of the crushing rotor 61. Though described later in detail, the first and second anvils 62, 63 are constructed to be able to retract in respective directions following the forward rotating direction of the crushing rotor 61 (see FIG. 11, etc.), for example, when an excessive impact is applied to the anvils.

The crushing rotor 61 is rotatably supported by bearings (not shown) each of which is mounted to, e.g., the side cover 45 of the crushing apparatus 12 (or a not-shown support member separately provided on the body frame 36). A plurality of support members 64 and crushing bits (i.e., bump plates or crushing blades) 65 mounted respectively to the support members 64 are provided on an outer circumferential surface of the crushing rotor 61. The crushing bits 65 are arranged such that their edge faces precede the corresponding support members 64 when the crushing rotor 61 is rotated in the forward direction. Also, the crushing bits 65 are fixed to the support members 64 by bolts 66 or the likes, and therefore they can be easily replaceable when worn out. In FIG. 10, numeral 67 denotes a driving unit (i.e., a hydraulic motor for the crushing rotor) for rotating the crushing rotor 61. Though not specifically shown, the driving unit 67 is fixed to the side cover 45 of the crushing apparatus 12 by bolts or the likes and has an output shaft coupled to a rotary shaft of the crushing rotor 61 through a driving power transmission mechanism using, e.g., a belt.

The crushing chamber 60 is substantially defined by the curved plate 68 disposed above the crushing rotor 61, and a first screen (first sieve member) 69 and a second screen (second sieve member) 70 which are disposed respectively forward of and under the crushing rotor 61 and have a large number of holes formed in an appropriate diameter to set a grain size of the crushed woods (wood chips). The crushing chamber 60 is opened at the rear side to provide a target wood receiving area. The curved plate 68 is attached to the lower curved surface of the arm portion 54 of the pressing conveyor unit 13, as described above, and it is movable with vertical swing motion of the pressing conveyor unit 13. Like the curved plate 68, the first and second screens 69, 70 are formed in a circular-arc shape so as to extend substantially along the rotation locus of the crushing rotor 61 in a movable manner while predetermined gaps are kept relative to the crushing bit 65 during the crushing work (described later in detail).

Figure 12:
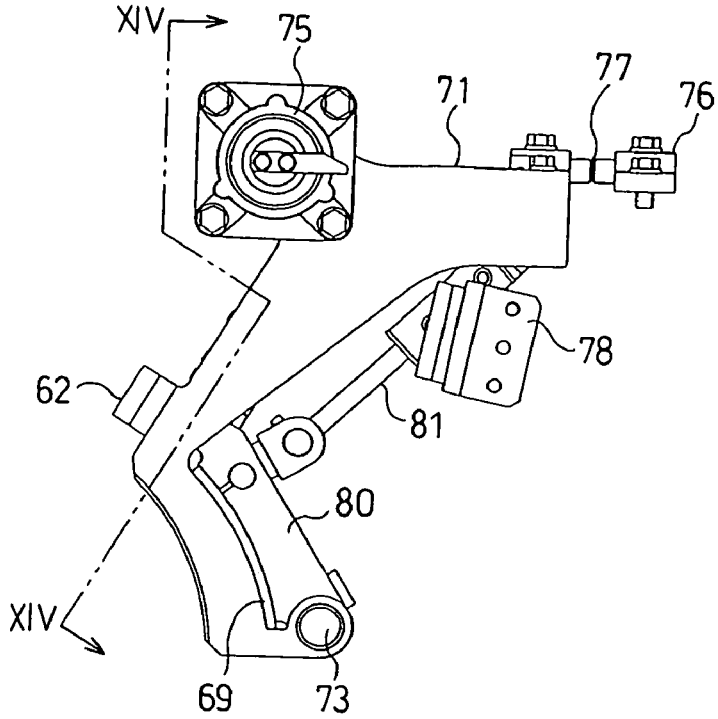
FIG. 12 is a view showing in detail a mechanism for moving a first anvil and a first screen in the extracted form along with a structure in the vicinity thereof, which are provided in the wood crusher according to one embodiment of the present invention.
Figure 13:
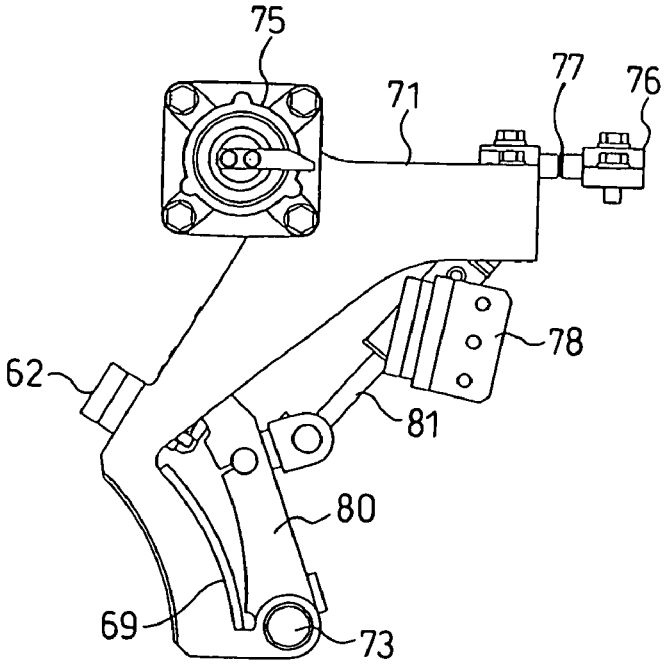
FIG. 13 is a view showing in detail the mechanism for moving the first anvil and the first screen in the extracted form along with the structure in the vicinity thereof, which are provided in the wood crusher according to one embodiment of the present invention.
Figure 14:
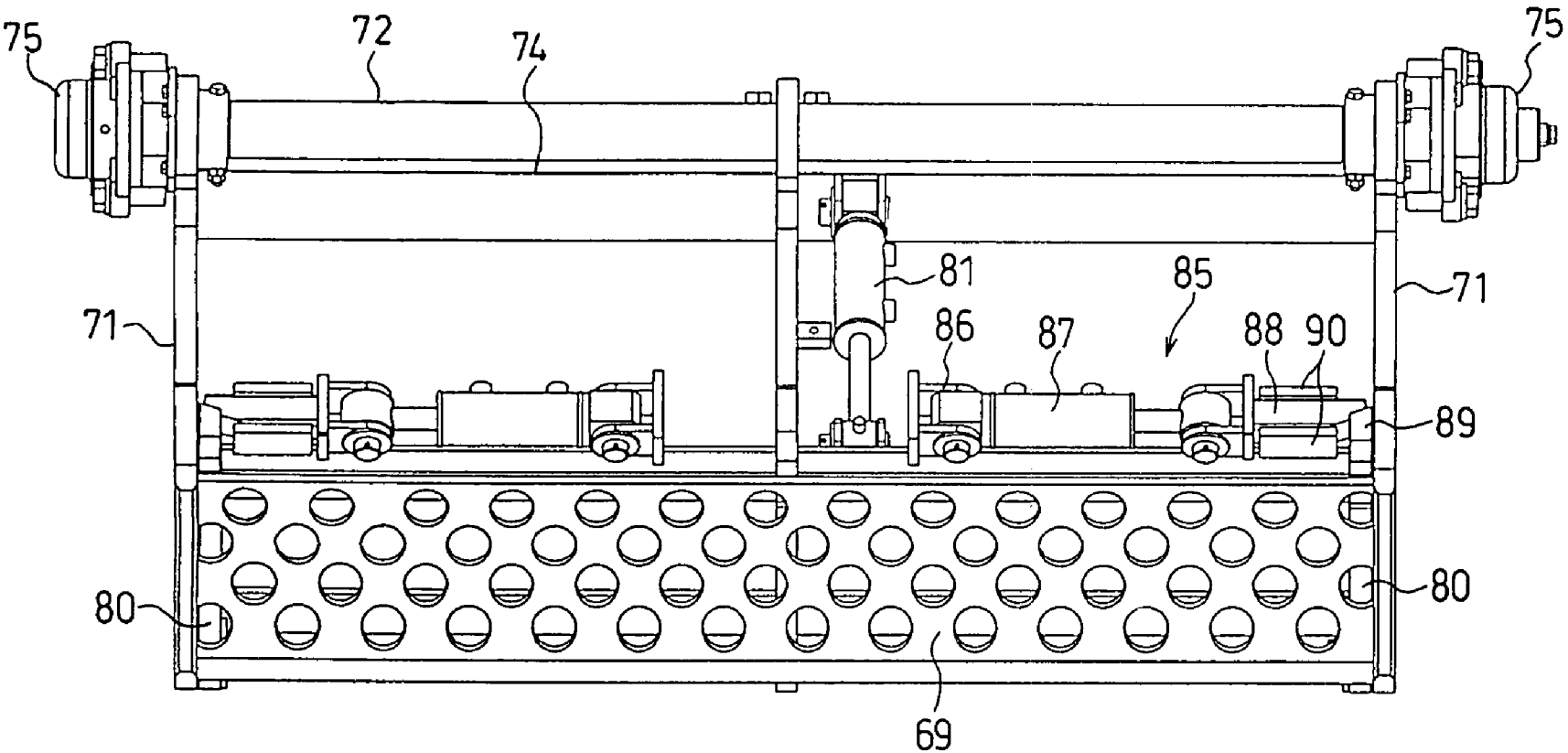
FIG. 14 is a sectional taken along the line XIV-XIV in FIG. 12 and looking in the direction of an arrow, the view showing in detail the mechanism for moving the first anvil and the first screen in the extracted form along with the structure in the vicinity thereof, which are provided in the wood crusher according to one embodiment of the present invention.

FIGS. 12 and 13 are each a view showing in detail a mechanism for moving the first anvil 62 and the first screen 69 in the extracted form along with a structure in the vicinity thereof, and FIG. 14 is a sectional taken along the line XIV-XIV in FIG. 12 and looking in the direction of an arrow. Similar components in FIGS. 12, 13 and 14 to those in the above-described drawings are denoted by the same symbols and a description of those components is omitted here.

Referring to FIGS. 12 through 14, numeral 71 denotes an arm to which the first anvil 62 is mounted. A pair of arms 71 are disposed in spaced relation in the transverse direction (i.e., in the right and left direction as viewed in FIG. 14) and are connected to each other by two rotary shafts 72, 73 and a beam 74. For example, one rotary shaft 72 is supported by bearings 75 each mounted to the outer wall surface of the crusher side cover 45 (see FIG. 10) such that the arms 71 are rotatable about the rotary shaft 72 serving as a fulcrum. The rotary shafts 72, 73 are extended in the direction substantially parallel to the rotary shaft of the crushing rotor 61.

A front end of each arm 71 is coupled through a shear pin 77 to a support member 76 fixed to the crusher side cover 45. Then, the arms 71 are fixed and held in such a posture that, during the crushing work (e.g., in the state shown in FIG. 3), the first anvil 62 is positioned on one side (i.e., the lower side as viewed in FIG. 12) of the curved plate 68 in the circumferential direction thereof (i.e., in the circumferential direction of the crushing rotor 61) and is projected inward of an inner wall surface of the curved plate 68 in the radial direction thereof (i.e., in the radial direction of the crushing rotor 61). Accordingly, for example, when an impact load in excess of the allowable limit set for the shear pin 77 is applied to the first anvil 62, the shear pin 77 is broken, whereby each arm 71 is released from a restricted state and is retracted from the crushing chamber 60. As a result, the associated components are protected from damages.

In this connection, the angular turning of the arms 71 is detected, for example, by a sensor for detecting the rotation of the rotary shaft 72. When the angular turning of the arms 71 is detected by the sensor, a controller (not shown) outputs a command signal to stop the driving unit 67 for the crushing rotor 61.

Additionally, numeral 78 denotes a stopper fixed to, e.g., the crusher side cover 45 (or a not-shown support member separately provided on the body frame 36). The stopper 78 limits an allowable range of the angular turning of the arms 71 in the direction in which the first anvil 62 is retracted, to thereby prevent interference between the arms 71 and any other components.

Numeral 80 denotes a screen support member (screen holder) having a frame-like shape and pressing the first screen 69 against the arms 71 from the outer peripheral side to hold the first screen 69 in place. One end of the screen support member 80 on one side (i.e., the lower side as viewed in FIG. 12) in the circumferential direction thereof (i.e., in the circumferential direction of the crushing rotor 61) is coupled to the arms 71 through the rotary shaft 73. Also, the other end of the screen support member 80 on the other side in the circumferential direction thereof is coupled to the beam 74 through a hydraulic cylinder 81. Opposite ends of the hydraulic cylinder 81 are pivotally coupled to the screen support member 80 and the beam 74 through pins, respectively. With the extending and contracting operation of the hydraulic cylinder 81, the screen support member 80 is rotated relative to the arms 71. In other words, when the hydraulic cylinder 81 is contracted, the screen support member 80 is moved away from the first screen 69, thus allowing the first screen 69 to be easily replaced. In FIGS. 10 and 11, numeral 82 denotes an opening formed in the crusher side cover 45 such that the first screen 69 can be withdrawn and inserted through the opening 82, taking into account the replacement of the first screen 69. Though not specifically shown, the opening 82 is closed, for example, by a cover fixed in place using bolts in a detachable way.

In FIG. 14, numeral 85 denotes a mechanism for locking the screen support member 80. The locking mechanism 85 comprises a bracket 86 in fixed relation to the corresponding arm 71, a lock cylinder 87 having a bottom-side end fixed to the bracket 86 and disposed to lie in the transverse direction (i.e., in the right and left direction as viewed in FIG. 14), tapered blocks 88, 89 fixed respectively to a rod-side end of the lock cylinder 87 and the screen support member 80 and capable of engaging with each other, and a guide member 90 for guiding the tapered block 88 when it slides with the extending and contracting operation of the lock cylinder 87.

Figure 15:
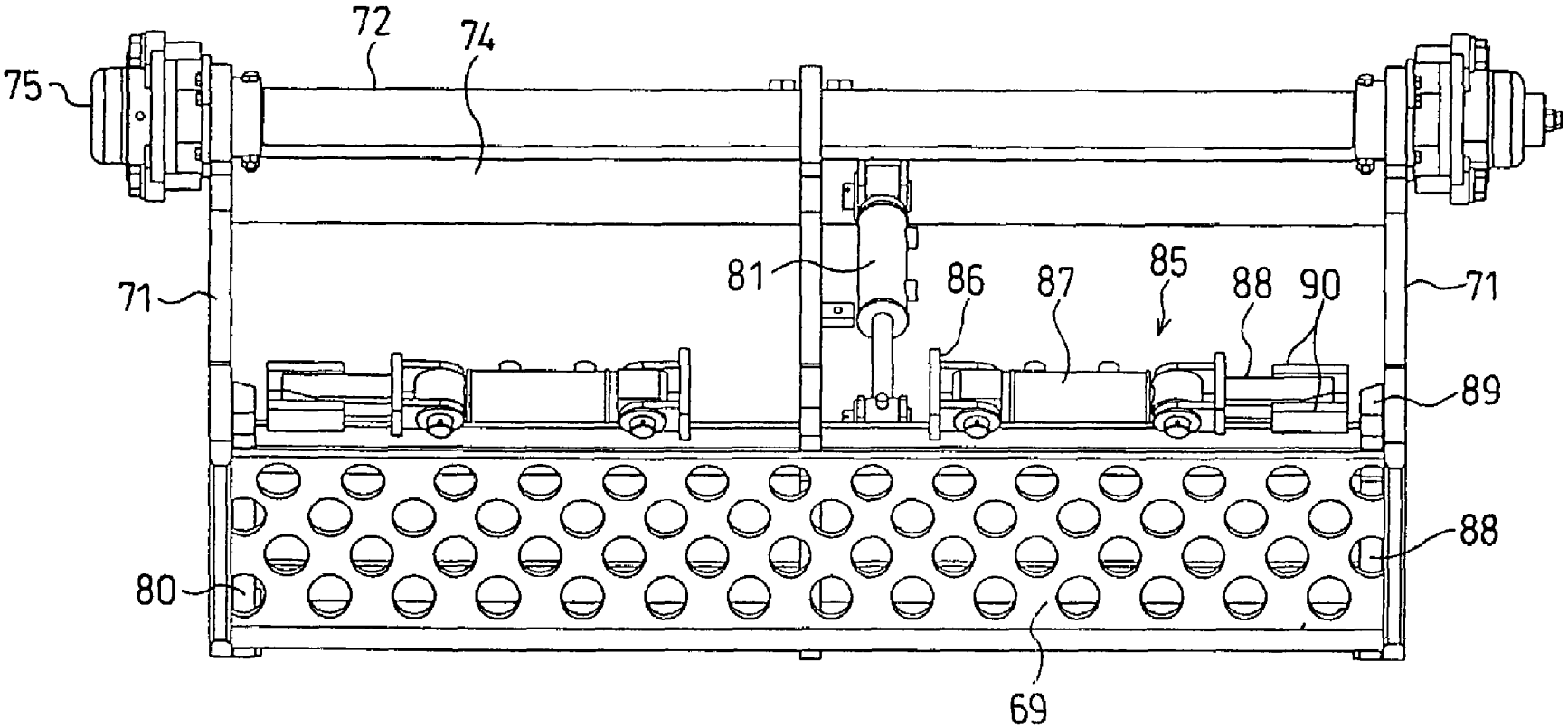
FIG. 15 is a view showing an unlocked state of the first screen provided in the wood crusher according to one embodiment of the present invention.

When the first screen 69 is tightly held between the screen support member 80 and the arms 71, the tapered block 88 in fixed relation to the arm 71 engages with the tapered block 89 provided on the screen support member 80 from the outer side in the radial direction (i.e., in the radial direction of the crushing rotor 61). More specifically, when the first screen 69 is tightly held therebetween, the lock cylinder 87 is extended to bring the tapered blocks 88, 89 into engagement with each other, whereby the rotating operation of the screen support member 80 is restricted. As a result, the first screen 69 is firmly fixed and held at the position (i.e., the position shown in FIG. 3) where the crushing chamber 60 during the crushing work is defined as intended. When the hydraulic cylinder 81 is contracted to rotate the screen support member 80 for replacement of the first screen 69 as described above, the lock cylinder 87 is initially contracted to disengage the tapered blocks 88, 89 from each other. This unlocked state is shown in FIG. 15 that corresponds to FIG. 14. While in this embodiment the locking mechanism 85 is disposed on each of both sides of the first screen 69 in the transverse direction (i.e., in the right and left direction as viewed in FIG. 14), the locking mechanism 85 on either side may be omitted when the provision of the locking mechanism 85 only on one side is sufficient to ensure the satisfactory operation.

Returning to FIGS. 3, 10 and 11, numeral 91 denotes a frame-shaped arm to which the second anvil 63 is mounted. A rotary shaft (not shown) of the arm 91 is supported by bearings 92 each mounted to, e.g., the outer wall surface of the crusher side cover 45 (see FIG. 10) (or a not-shown support member separately provided on the body frame 36) such that the arm 91 is rotatable about the rotary shaft serving as a fulcrum. The rotary shaft is extended in the direction substantially parallel to the rotary shaft of the crushing rotor 61.

A front end of the arm 91 is coupled through a shear pin 94 to a support member 93 fixed to the crusher side cover 45. Then, the arm 91 is fixed and held in such a posture that, during the crushing work (e.g., in the state shown in FIG. 3), the second anvil 63 is positioned on one side (i.e., the lower side as viewed in FIG. 3) of the first screen 69 in the circumferential direction thereof (i.e., in the circumferential direction of the crushing rotor 61) and is projected inward of an inner wall surface of the first screen 69 in the radial direction thereof (i.e., in the radial direction of the crushing rotor 61). Accordingly, for example, when an impact load in excess of the allowable limit set for the shear pin 94 is applied to the second anvil 63, the shear pin 94 is broken, whereby the arm 91 is released from a restricted state and is retracted from the crushing chamber 60. As a result, the associated components are protected from damages.

In this connection, the angular turning of the arm 91 is detected, for example, by a sensor for detecting the rotation of the rotary shaft of the arm 91. When the angular turning of the arms 91 is detected by the sensor, the controller (not shown) outputs a command signal to stop the driving unit 67 for the crushing rotor 61.

Additionally, numeral 95 denotes a stopper fixed to, e.g., the crusher side cover 45 (or a not-shown support member separately provided on the body frame 36). The stopper 95 limits an allowable range of the angular turning of the arm 91 in the direction in which the second anvil 63 is retracted, to thereby prevent interference between the arm 91 and any other components.

Figure 16A:
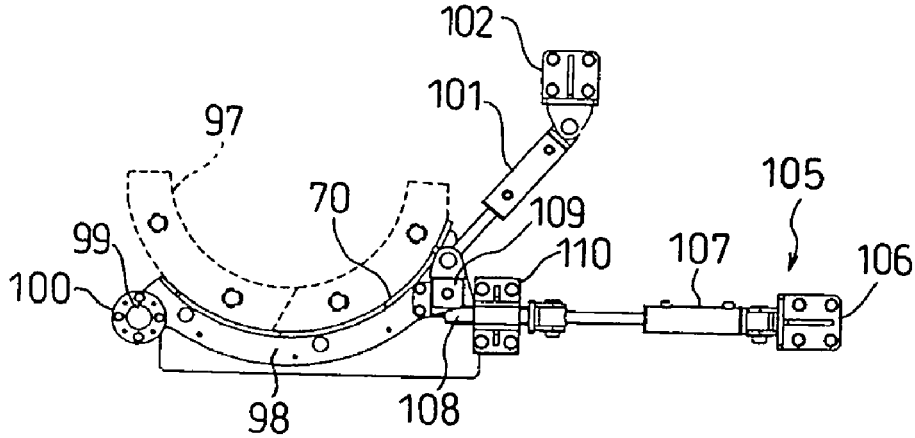
FIGS. 16A, 16B and 16C are each a view showing in detail a mechanism for moving a second screen in the extracted form along with a structure in the vicinity thereof, which is provided in the wood crusher according to one embodiment of the present invention.
Figure 16B:
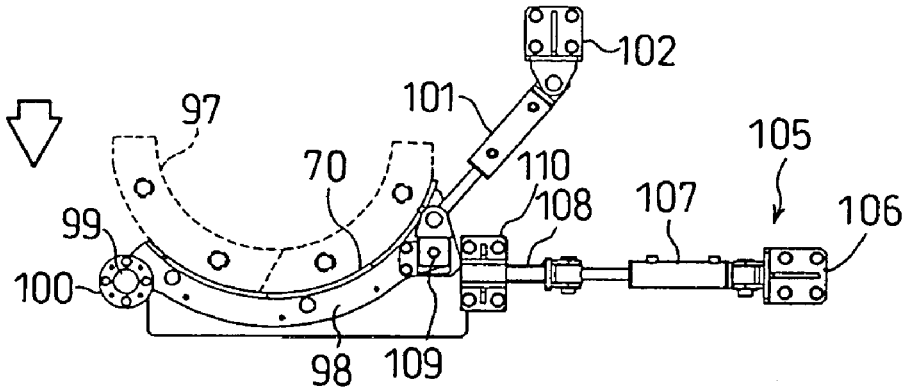
Figure 16C:
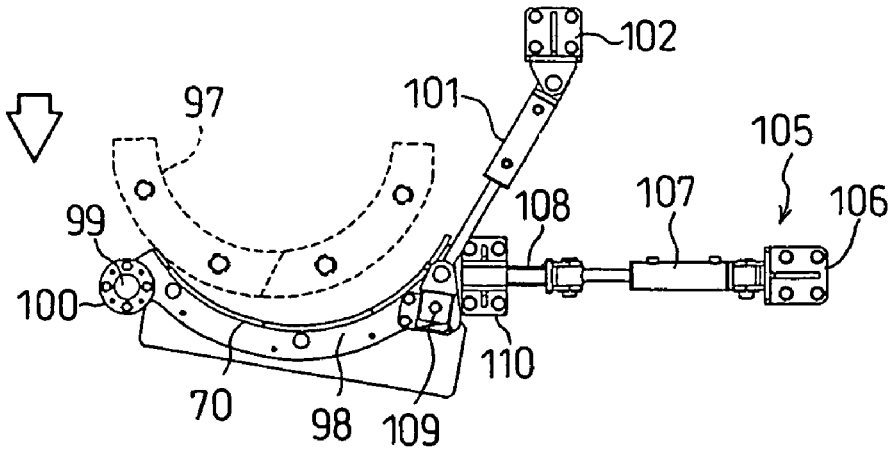

FIGS. 16A through 16C are each a view showing in detail a mechanism for moving the second screen 70 in the extracted form along with a structure in the vicinity thereof. Similar components in FIGS. 16A through 16C to those in the above-described drawings are denoted by the same symbols and a description of those components is omitted here.

Referring to FIGS. 16A through 16C, numeral 97 denotes a retaining plate 97 for retaining the second screen 70. The retaining plate 97 is formed to have an outer peripheral surface substantially in match with the curvature of an inner wall surface of the second screen 70 and is fixed by, e.g., bolts such that, during the crushing work (or in the state shown in FIG. 16A), the inner wall surface of the second screen 70 abuts against the outer peripheral surface of the retaining plate 97 mounted to the inner wall surface of the crusher side cover 45 (or a not-shown support member separately provided on the body frame 36). Numeral 98 denotes a screen support member (screen holder) having a frame-like shape and pressing the second screen 70 against the retaining plate 97 from the outer peripheral side to hold the second screen 70 in place. The screen support member 98 has a rotary shaft 99 disposed at its one end on one side (i.e., the left side as viewed in FIG. 16) in the circumferential direction thereof (i.e., in the circumferential direction of the crushing rotor 61), and the rotary shaft 99 is supported by bearings 100 each fixed to the crusher side cover 45 (or a not-shown support member separately provided on the body frame 36) such that the screen support member 98 is rotatable in the vertical direction.

The other end of the screen support member 98 on the other side in the circumferential direction thereof is coupled to a support member 102 fixed to the outer wall surface of the crusher side cover 45 by, e.g., bolts through a hydraulic cylinder 101. Opposite ends of the hydraulic cylinder 101 are pivotally coupled to the screen support member 98 and the support member 102 through pins, respectively. With the extending and contracting operation of the hydraulic cylinder 101, the screen support member 98 is rotated about the rotary shaft 99 serving as a fulcrum. Thus, when the hydraulic cylinder 101 is extended, the screen support member 98 is moved away from the second screen 70, thus allowing the second screen 70 to be easily replaced. In FIGS. 10 and 11, numeral 103 denotes a cutout formed in the crusher side cover 45 such that the second screen 70 can be withdrawn and inserted through the cutout 103, taking into account the replacement of the second screen 70. Though not specifically shown, the cutout 103 is closed, for example, by a cover fixed in place using bolts in a detachable way.

Further, numeral 105 denotes a mechanism for locking the screen support member 98. The locking mechanism 105 comprises a bracket 106 fixed to the outer wall surface of the crusher side cover 45, a lock cylinder 107 having a bottom-side end fixed to the bracket 106 and disposed to lie in the longitudinal direction (i.e., in the right and left direction as viewed in FIG. 16), tapered blocks 108, 109 fixed respectively to a rod-side end of the lock cylinder 107 and the screen support member 98 and capable of engaging with each other, and a guide member 110 fixed to the outer wall surface of the crusher side cover 45 by, e.g., bolts and guiding the tapered block 108 when it slides with the extending and contracting operation of the lock cylinder 107.

Figure 17:
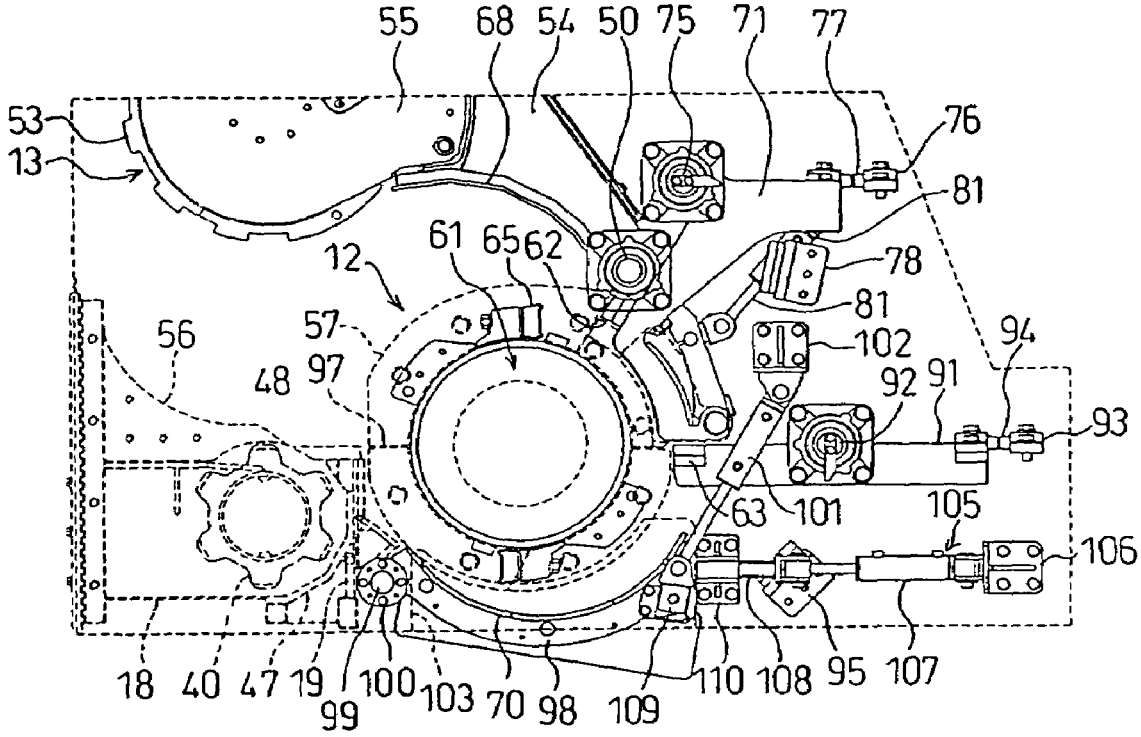
FIG. 17 is a view showing a structure around the crushing apparatus in an unlocked state of the second screen provided in the wood crusher according to one embodiment of the present invention.

When the second screen 70 is tightly held between the screen support member 98 and the retaining plate 97, the tapered block 108 engages with the tapered block 109 provided on the screen support member 98 from the outer side in the radial direction (i.e., in the radial direction of the crushing rotor 61). More specifically, when the second screen 70 is tightly held therebetween, the lock cylinder 107 is extended to bring the tapered blocks 108, 109 into engagement with each other, whereby the rotating operation of the screen support member 98 is restricted. As a result, the second screen 70 is firmly fixed and held at the position (i.e., the position shown in FIG. 16A) where the crushing chamber 60 during the crushing work is defined as intended. When the hydraulic cylinder 101 is extended to rotate the screen support member 98 for replacement of the second screen 70 as shown in FIG. 16C, the lock cylinder 107 is initially contracted to disengage the tapered blocks 108, 109 from each other as shown in FIG. 16B. FIG. 17 shows the crushing apparatus 12 and thereabout in such an unlocked state. While the locking mechanism 105 is preferably disposed on each of both sides of the second screen 70 in the transverse direction (i.e., in the direction perpendicular to the drawing sheet of FIG. 16A), the locking mechanism 85 on either side may be omitted when the provision of the locking mechanism 105 only on one side is sufficient to ensure the satisfactory operation.

Returning to FIGS. 1 and 2, a portion of the discharge conveyor 3 on the discharge side (i.e., the front side or the right side as viewed in FIGS. 1 and 2) is supported in a suspended state by a support member 112 projecting from the power unit 4. Also, another portion of the discharge conveyor 3 on the opposite side (i.e., the rear side or the left side as viewed in FIGS. 1 and 2) is supported by a support member 113 in a state suspended from the body frame 36. Thus, the discharge conveyor 3 is disposed so as to pass under the crushing apparatus 12 and the power unit 4, and to further extend externally forward of the wood crusher while inclining upward. Numeral 114 denotes a frame of the discharge conveyor 3, and 115 denotes a conveyor belt looped between a drive wheel (not shown) and a driven wheel (not shown) disposed at opposite ends of the frame 114 in the longitudinal direction thereof. Numeral 116 denotes a driving unit (i.e., a hydraulic motor for the discharge conveyor) for rotating the drive wheel. By rotating the driving 116, the conveyor belt 115 is driven to circulate between the drive wheel and the driven wheel.

The power unit 4 is mounted on one end portion of the body frame 36 on the other side in the longitudinal direction (i.e., on the right side as viewed in FIGS. 1 and 2) through a support member 117. Behind the power unit 4, a cab 118 is provided in an area on one side (i.e., the lower side as viewed in FIG. 2) in the transverse direction. Numeral 119 denotes a control lever disposed in the cab 118 for the travel operation, and 120 denotes a console used for performing other operations, setting, monitoring, etc. In this embodiment, the console 120 is disposed on the lateral side of the crusher body so that an operator can easily operate the console while standing on the ground, but it may be disposed in the cab 118.

Figure 18:
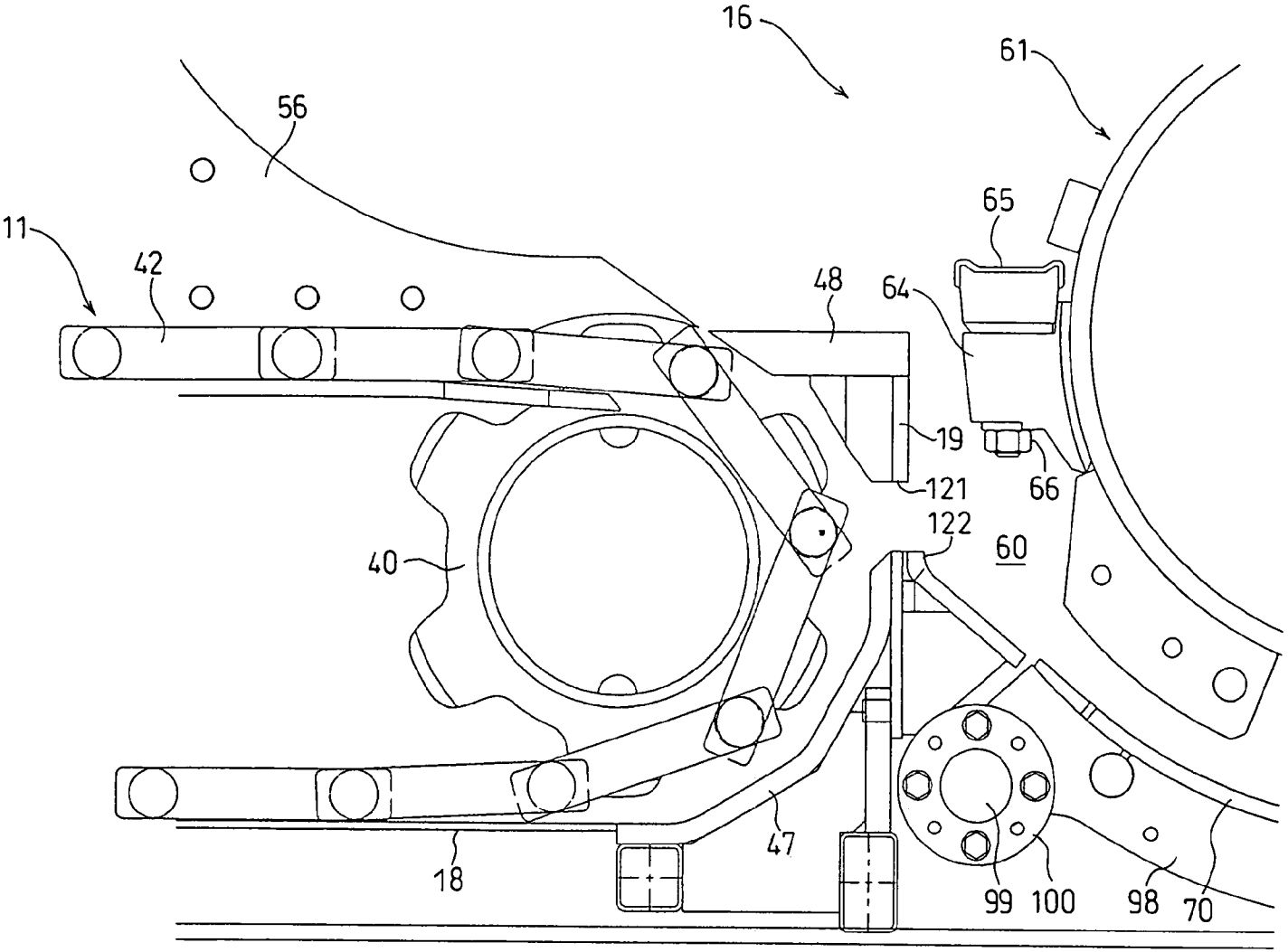
FIG. 18 is a side sectional view showing a detailed structure of a portion of the feed conveyor on the side nearer to a crushing chamber, which is provided in the wood crusher according to one embodiment of the present invention.

FIG. 18 is a side sectional view showing a detailed structure of a portion of the feed conveyor 11 on the side nearer to the crushing chamber 60. Similar components in FIG. 18 to those in the above-described drawings are denoted by the same symbols and a description of those components is omitted here.

As shown in FIG. 18, an opening 121 is formed in the front wall 19 of the hopper 10 such that the opening 121 is positioned in front of the feed conveyor 11 and communicated with the crushing chamber 60. The target woods, i.e., the wood pieces to be crushed, which have entered the lower side (return run side) of the feed conveyor 11 from the hopper 10, can be introduced to the crushing chamber 60 through the opening 121. The above-mentioned guide member 47 is disposed to extend from the bottom wall 18 toward the opening 121 in the front wall 19 so that the wood pieces having been entrained to the return run side of the feed conveyor 11 are guided toward the opening 121. Though not specifically shown, a cover for making the opening 121 open and closed can be provided on the front wall 19. Such a cover may be constructed in a detachable manner using, e.g., bolts, or in a sliding or turning manner to open and close the opening 121.

Further, in this embodiment, the front wall 19 of the hopper 10 is provided with a kickback plate 122 positioned below the opening 121 on the outlet side to serve as means for preventing intrusion of the crushed woods. The kickback plate 122 is fixed to an outer wall surface of the front wall 19 in adjacent relation to the second screen 70 such that an upper end of the kickback plate 122 is flush with a lower end of the opening 121 and the kickback plate 122 defines a part of the crushing chamber 60.

With the provision of the kickback plate 122, in this embodiment, the outer wall surface of the front wall 19 on the side below the opening 121 is positioned nearer to the center of the crushing chamber 60 than the outer wall surface of the front wall 19 on the side above the opening 121, to thereby prevent the wood pieces under the crushing process from entering the hopper side from the crushing chamber 60 side through the opening 121. In FIG. 18, a portion of the kickback plate 122 near the opening 121 is formed so as to rise substantially in the vertical direction following the shape of the front wall 19. However, that portion of the kickback plate 122 is more preferably formed to curve toward the center of the crushing chamber 60. Also, the means for preventing intrusion of the crushed woods is not limited to the kickback plate 122 shown in FIG. 18, and can be constructed in any suitable form so long as it is able to prevent intrusion of the crushed woods into the hopper 10 through the opening 121.

The operation and advantages of the thus-constructed wood crusher according to this embodiment will be described below in sequence.

When the target woods are loaded into the hopper 10 by using an appropriate working device, e.g., a grapple of a hydraulic excavator, the target woods are dropped to be put on the running members 42 of the feed conveyor 11 while being guided by the spreading portion 17 of the hopper 10. Then, the target woods are substantially horizontally conveyed toward the front side of the wood crusher with the circulating conveyor running members 42 while being guided by the side walls 16 of the hopper 10.

When the target woods on the feed conveyor 11 are conveyed to a position near the pressing conveyor unit 13, they come into under the pressing roller 53 of the pressing conveyor unit 13 and push up the pressing conveyor unit 13. Then, the target woods on the feed conveyor 11 are introduced to the crushing chamber 60 in a state pressed and gripped between the pressing roller 53 and the feed conveyor 11 under action of the dead weight of the pressing conveyor unit 13. In the crushing, therefore, the target woods are projected into the crushing chamber 60 in the cantilevered form with their ends on one side gripped between the pressing roller 54 and the feed conveyor 11. The projected wood portions are smashed by the crushing bits 65 of the rotating crushing rotor 61 and are comparatively roughly crushed, i.e., subjected to primary crushing. The wood pieces having been subjected to the primary crushing are forced to move in the rotating direction of the crushing rotor 61 through a space in the crushing chamber 60 around the crushing rotor 61 while bumping against the first and second anvils 62, 63 successively. With the impact forces caused upon while bumping against those anvils, the target woods are more finely crushed, i.e., subjected to secondary crushing.

Of the wood pieces thus crushed and still under the crushing, those pieces having'sizes larger than the diameter of many holes formed in the first and second screens 69, 70 continue to circulate in the crushing chamber 60 and are repeatedly smashed by the crushing bits 65 and bumping against the first and second anvils 62, 63 again, so that the wood pieces are further crushed into smaller sizes. When the wood pieces are crushed into grain sizes enough to pass through the holes in the first and second screens 69, 70, the crushed woods (wood chips) are discharged from the crushing apparatus 12 after passing through the holes in the first and second screens 69, 70.

The crushed woods (wood chips) discharged from the crushing apparatus 12 are dropped on the conveyor belt 115 of the circulating discharge conveyor 3 through a chute (not shown). Thereafter, they are conveyed toward the front side (i.e., the right side as viewed in FIGS. 1 and 2) and are discharged as recycled articles.

As described above, the scraper 48 provided on the front wall 19 of the hopper 10 is positioned near the front end of the feed conveyor 11. The provision of the scraper 48 serves not only to minimize an entrance led to a gap between the front wall 19 of the hopper 10 and the feed conveyor 11, but also to prevent the target woods conveyed by the feed conveyor 11 from being introduced to the gap between the front wall 19 and the feed conveyor 11. As a result, the target woods are efficiently introduced to the crushing chamber 60.

However, because the drive wheel 40 and the running members 42 of the feed conveyor 11 are rotating bodies, a minimum gap must be left between each of the drive wheel 40 and the conveyor running members 42 and the scraper 48 that is a stationary body. During the crushing work, therefore, if some of the target woods conveyed by the feed conveyor 11 toward the crushing apparatus 12 are caught on the conveyor running members 42, the caught wood pieces may pass through the gap between the conveyor running members 42 and the scraper 48 to turn round the drive wheel 40 of the feed conveyor 11 without being introduced to the crushing chamber 60, and may be entrained to the lower side of the feed conveyor 11.

In this embodiment, to prevent the wood pieces thus entrained to the lower side (return run side) of the feed conveyor 11 from being dropped and scattered over the ground, the feed conveyor 11 is installed in the bottom-equipped hopper 10 such that the bottom wall 18 of the hopper 10 is disposed under the feed conveyor 11. If the wood pieces, etc. having been entrained to the return run side of the feed conveyor 11 stagnate on the bottom wall 18 of the hopper 10 and are concentrated near, e.g., the drive wheel 40 and the driven wheel 41 of the feed conveyor 11, those wood pieces would impede the smooth operation of the feed conveyor 11. With this embodiment, because the guide members 47, 35 are disposed respectively in close relation to the drive wheel 40 and the driven wheel 41, the wood pieces can be avoided from being accumulated near the drive wheel 40 and the driven wheel 41. It is hence possible to prevent the wood pieces from being dropped onto the ground during the crushing work, and to ensure the smooth operation state of the feed conveyor 11.

In addition, some wood pieces having been entrained to the lower side of the feed conveyor 11 are guided so as to move rearward by the bottom wall 18 of the hopper 10 while being caught on the conveyor running members 42, and are returned to on the conveying surface of the feed conveyor 11 and introduced to the crushing apparatus 12 again while being guided by the guide member 35 at the rear end of the hopper 10. As a result, some of the target woods to be crushed are prevented from being dropped and scattered over the ground without being introduced to the crushing apparatus 12, and the crushing efficiency can be improved.

Nevertheless, if the wood pieces having been entrained to the lower side of the feed conveyor 11 while being caught on the conveyor running members 42 are dislodged from the conveyor running members 42, the dislodged wood pieces may accumulate in the hopper 10.

Even in such a case, with this embodiment, because the opening 121 is formed in the front wall 19 of the hopper 10, the wood pieces accumulated in the hopper 10 without being introduced to the crushing apparatus 12 during the crushing work can be introduced to the crushing apparatus 12 through the opening 121 and can bee subjected to the crushing by driving the feed conveyor 11 backward. In other words, this embodiment enables the target woods loaded in the hopper 10 to be introduced to and crushed by the crushing apparatus 12 without losses. Consequently, it is possible to increase the efficiency in introducing the target woods to the crushing apparatus, and to improve the crushing efficiency.

Figure 19:
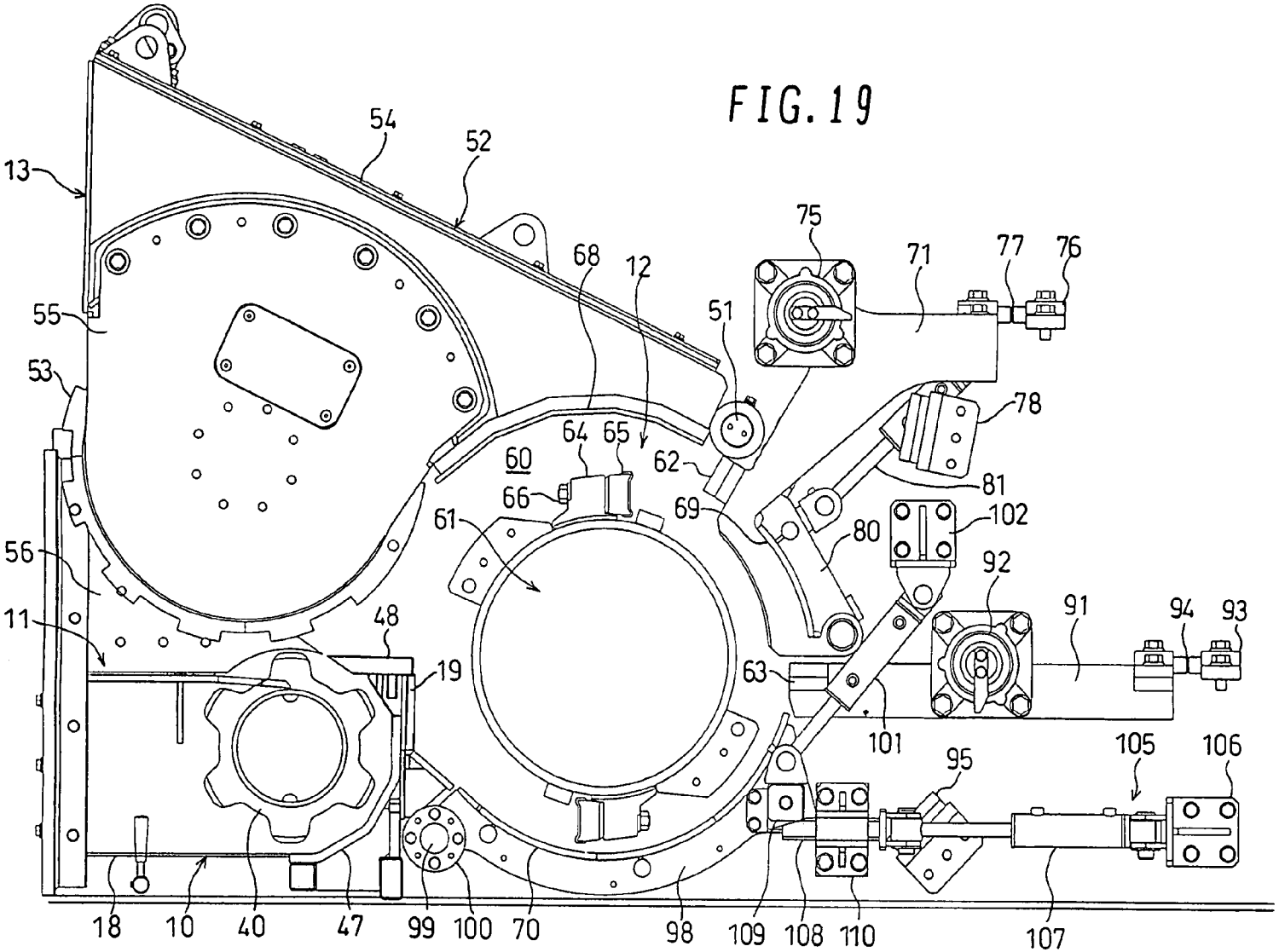
FIG. 19 is a side view showing another example of the detailed structure within the side covers in the vicinity of the crushing apparatus provided in the wood crusher according to one embodiment of the present invention.

While in this embodiment the opening 121 is formed in the front wall 19 of the hopper 10 so that the wood pieces having been entrained to the return run side of the feed conveyor 11 can be introduced to the crushing apparatus 12 through the opening 121 by driving the feed conveyor 11 backward, the opening 121 formed in the front wall 19 of the hopper 10 may be omitted, as shown in FIG. 19, when it is just intended to prevent the wood pieces from accumulating near the drive wheel 40 and the driven wheel 41 of the feed conveyor 11. Even in such a case, because the wood pieces can be prevented from accumulating near the drive wheel 40 and the driven wheel 41, it is possible to avoid the wood pieces from dropping onto the ground during the crushing work and to ensure the smooth operation state of the feed conveyor 11.

Figure 20:
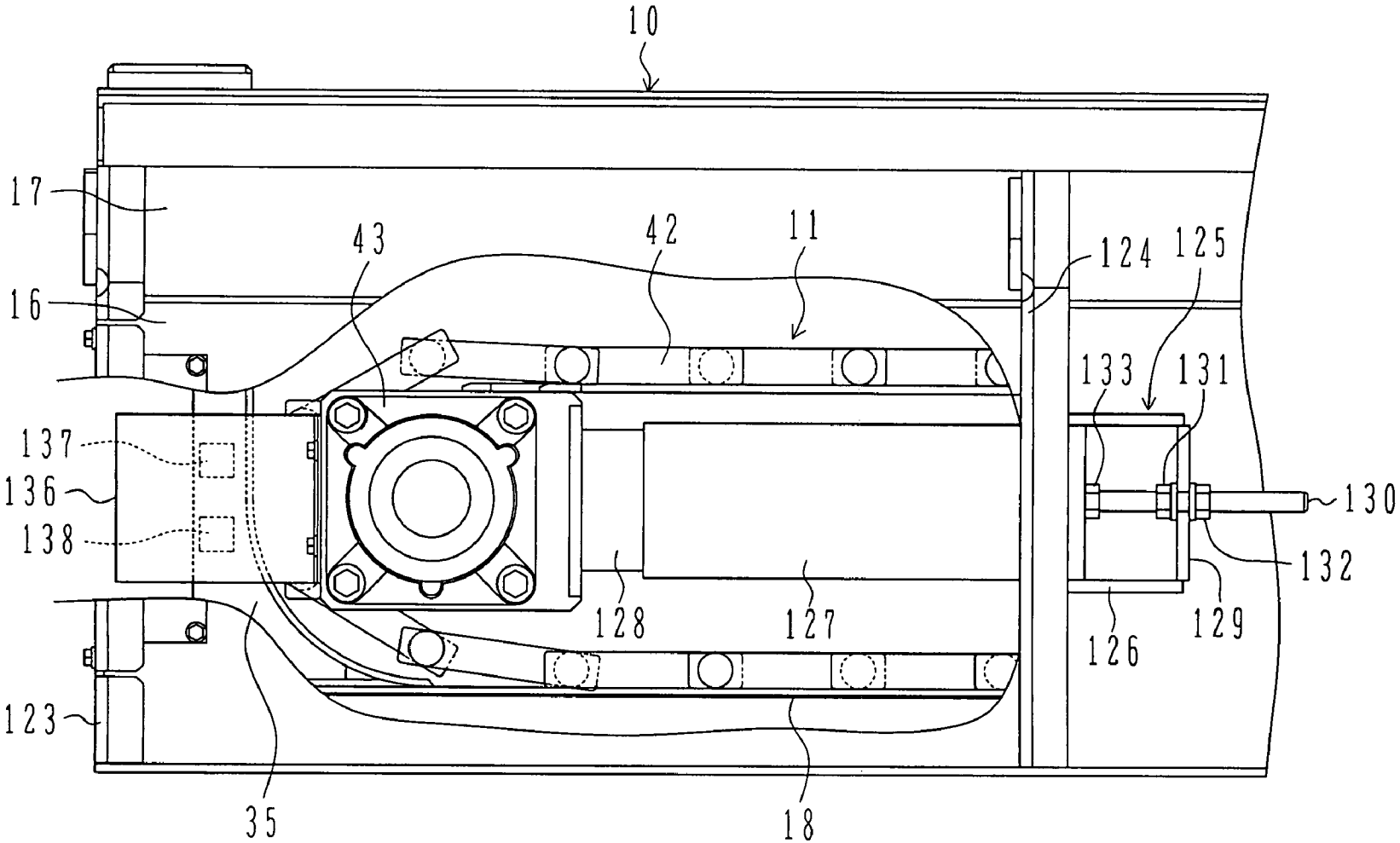
FIG. 20 is a side view, partly broken away, showing a detailed structure in the vicinity of a rear end of a hopper provided in a wood crusher according to another embodiment of the present invention.
Figure 21:
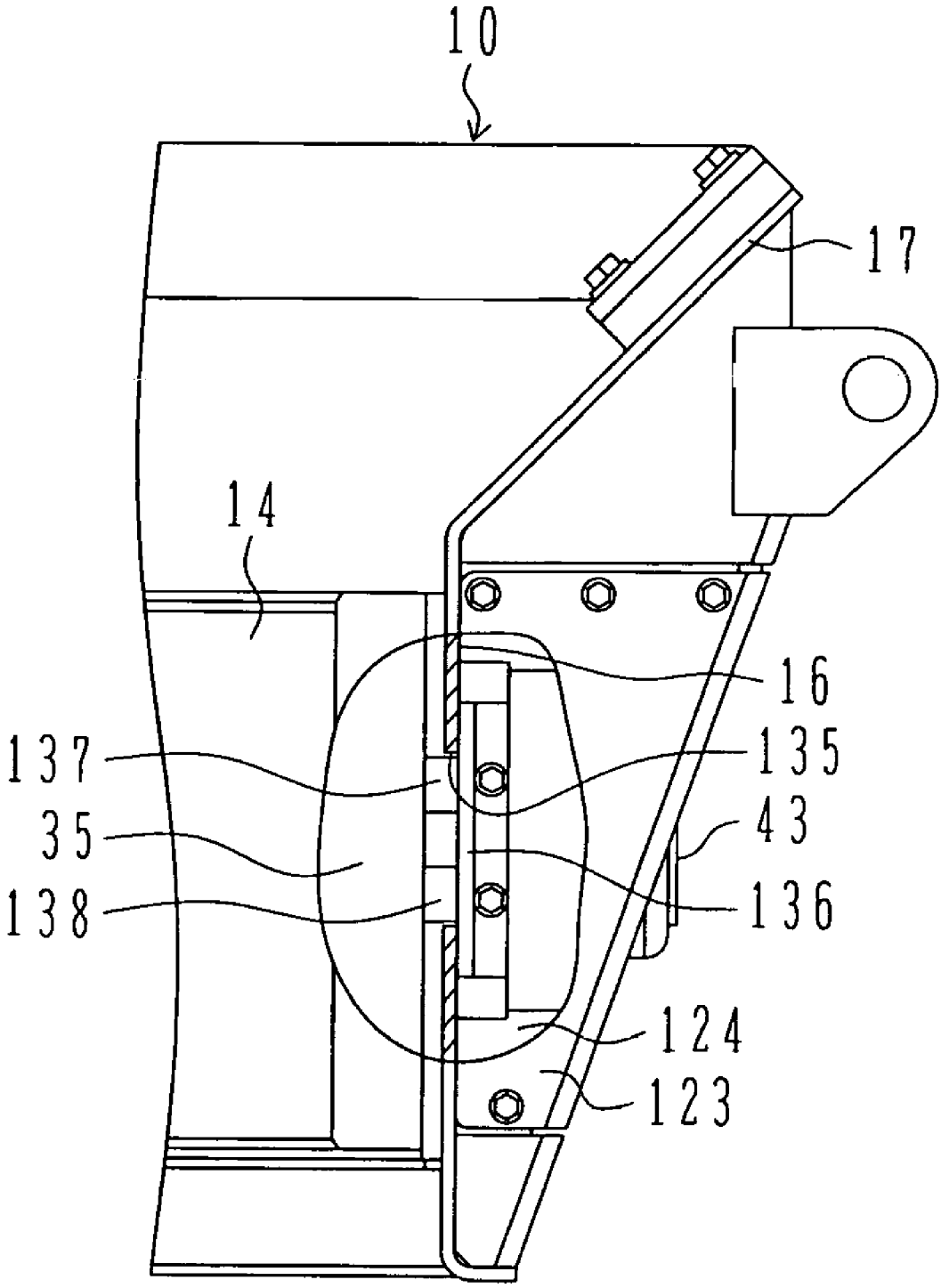
FIG. 21 is a direct rear view, partly sectioned, looking from the rear of the hopper provided in the wood crusher according to another embodiment of the present invention.

FIG. 20 is a side view, partly broken away, showing a detailed structure in the vicinity of a rear end of a hopper provided in a wood crusher according to another embodiment of the present invention, and FIG. 21 is a direct rear view, partly sectioned, looking from the rear of the hopper shown in FIG. 20. Components in FIGS. 20 and 21 being similar to or having similar functions to those in the above-described drawings are denoted by the same symbols and a description of those components is omitted here.

This embodiment is featured in that the guide member 35 is able to slide together with the driven wheel 41 of the feed conveyor 11 in the direction in which the target woods are conveyed by the feed conveyor 11. This feature will be described below.

Referring to FIGS. 20 and 21, ribs 123, 124 extending substantially vertically are disposed outside the hopper 10 in the transverse direction. The ribs 123, 124 are fixed to the side wall 16 and the spreading portion 17 of the hopper 10. A tension adjusting mechanism 125 for adjusting tension of the conveyor running members 42, which constitute an endless belt, is mounted to the rib 124 positioned forward of the bearing 43 that supports the driven wheel 41 (see FIG. 7) of the feed conveyor 11.

The tension adjusting mechanism 125 comprises a bracket 126 fixed to the rib 124, a guide member 127 having a tubular shape and fixed to both the side wall 16 of the hopper 10 and the rib 124, a slide member 128 supported by the guide member 127 to be able to slide in the direction in which the target woods are conveyed by the feed conveyor 11 (i.e., in the right and left direction as viewed in FIG. 20), a bolt 130 fixed to the slide member 128, and nuts 131, 132 screwed over the bolt 130 in sandwiching relation to a support plate 129 provided on the bracket 126. Numeral 133 denotes a nut for preventing loosening of the bolt 130.

A rear end of the slide member 128 is fixed to the bearing 43. A cutout 135 (see FIG. 21) is formed in the rear end portion of the side wall 16 of the hopper 10 so as to extend in the direction in which the target woods are conveyed by the feed conveyor 11. The shaft of the driven wheel 41 supported by the bearing 43 is arranged to penetrate the cutout 135 such that it is movable within the cutout 135. With such an arrangement, the driven wheel 41 and the bearing 43 of the feed conveyor 11 are able to slide together with the slide member 128 in the direction in which the target woods are conveyed by the feed conveyor 11 (i.e., in the horizontal direction).

Further, a bracket 136 is attached to a rear portion of the bearing 43. The bracket 136 is coupled to the guide member 35 through support members 137, 138. In this embodiment, the guide member 35 is not fixed to the bottom wall 18 of the hopper 10, but it is supported only by the bracket 136 through the support members 137, 138.

In FIGS. 20 and 21 showing this embodiment, mechanisms for opening and closing the bottom wall 18 of the hopper 10 (such as the opening/closing section 21 and the mechanism for rotating the rear wall 14 of the hopper 10, which are shown in FIG. 9) are omitted. The other construction than that illustrated is the same as in the above-described wood crusher according to one embodiment of the present invention, and similar advantages to those of one embodiment can be obtained.

In addition, according to this embodiment, by operating the nuts 131 through 133 of the tension adjusting mechanism 125 to adjust the amount by which the bolt 130 is projected from the bracket 126, the driven wheel 41 and the bearing 43 of the feed conveyor 11 can be moved through the slide member 128 in the direction in which the target woods are conveyed by the feed conveyor 11. Thus, the tension of the running members 42 of the feed conveyor 11 can be adjusted. Upon the tension adjustment, because the guide member 35 is coupled to the bearing 43 through the bracket 136 and the support members 137, 138, the guide member 35 is moved together with the driven wheel 41 in the direction in which the target woods are conveyed by the feed conveyor 11. Specifically, the guide member 35 is moved back and forth while sliding over the bottom wall 18.

If the position of the guide member 35 remains the same in spite of the driven wheel 41 being moved, the driven wheel 41 may interfere with the guide member 35 or may be positioned farther away from the guide member 35 than necessary. Such a case may lead to a risk that the operation of the feed conveyor 11 is affected, or that the target woods, i.e., the wood pieces to be crushed, loaded in the hopper 10 are more likely to accumulate between the driven wheel 41 and the guide member 35.

In contrast, with this embodiment, because the guide member 35 is movable together with the driven wheel 41, the distance between the guide member 35 and the driven wheel 41 can be always kept at an appropriate value set in advance. Accordingly, even when the driven wheel 41 is moved for the necessity of, e.g., the tension adjustment of the conveyor running members 42, the driven wheel 41 is avoided from interfering with the guide member 35 or from being positioned farther away from the guide member 35 than necessary. As a result, it is possible to prevent such a trouble that, with the movement of the driven wheel 41, the operation of the feed conveyor 11 is affected, or the target woods, i.e., the wood pieces to be crushed, loaded in the hopper 10 are more likely to accumulate between the driven wheel 41 and the guide member 35.

In the embodiments described above, the pressing conveyor unit 13 is employed as the means for pressing and introducing the target woods, but the present invention is not limited to the illustrated embodiments. For example, the pressing conveyor unit 13 may be replaced with a means including a drive roller and a driven roller between which an endless member (e.g., a belt or a chain) is looped. Also, the operation of pressing the target woods may be realized with vertical movement instead of the rotating operation. These modifications can also provide similar advantages obtainable with the above-described embodiments.

Further, the present invention has been described above in connection with, by way of example, the wood crusher including the so-called impact crusher as the crushing apparatus in which blades (crushing bits 65) are mounted to the outer circumference of the crushing rotor 61. However, the present invention is not limited to that type of crusher and can also be applied to wood crushers including other types of crushing apparatuses, such as a crushing apparatus in which cutters are provided over two shafts arranged parallel to each other and are rotated in opposite directions, to thereby shear target woods (e.g., a 2-shaft shearing machine including the so-called shredder), a rotary crushing apparatus in which a pair of roll-shaped rotating bodies (rotors) each provided with crushing blades are rotated in opposite directions, and target woods are crushed while passing between the rotating bodies in sandwiched condition (e.g., a 6-shaft crusher including the so-called roll crusher), and a wood crusher equipped with the so-called wood chipper for breaking target woods into chips. Any of those cases can also provide similar advantages obtainable with the above-described embodiments.

Moreover, the above description has been made of, by way of example, the case where the present invention is applied to a self-propelled wood crusher, but the present invention is not limited to such an application. As a matter of course, the present invention is also applicable to, e.g., a mobile wood crusher capable of traveling with traction, a transportable wood crusher capable of being lifted by, e.g., a crane and transported, and a stationary wood crusher installed as a fixed machine in a plant or the like. Any of those applications can also provide similar advantages obtainable with the above-described embodiments.

According to the present invention, since the feed conveyor is installed in the bottom-equipped hopper, the wood pieces having been entrained to the lower side of the feed conveyor can be prevented from dropping onto the ground. Also, since the guide members are disposed in close relation to the drive wheel and the driven wheel of the feed conveyor, it is possible to prevent the wood pieces from accumulating near the drive wheel and the driven wheel, and to ensure the smooth operation state of the feed conveyor.

What is claimed is:

1. A wood crusher comprising:

a body frame;

a crushing apparatus installed on said body frame and including a crushing rotor rotated in a crushing chamber;

a feed conveyor installed on one side of said body frame in the longitudinal direction thereof and including a drive wheel, a driven wheel, and a running member looped between said drive wheel and said driven wheel, thereby conveying woods to be crushed to said crushing apparatus;

a bottom-equipped hopper having side walls disposed on both sides of said feed conveyor in the transverse direction thereof, and a bottom wall disposed under said feed conveyor, and a front wall disposed forward of said feed conveyor; and a guide member disposed in continuation with the bottom wall of said hopper at a position near said drive wheel of said feed conveyor to prevent wood pieces from accumulating near said drive wheel, wherein said guide member is formed substantially in a circular-arc shape to extend in proximity to a locus along which said drive wheel of said feed conveyor is rotated and is connected to the bottom wall and the front wall of said hopper.

2. A wood crusher according to claim 1, wherein said hopper has an opening formed in said front wall to be communicated with said crushing chamber, and said guide member is disposed to extend from the bottom wall of said hopper toward the opening formed in said front wall.

3. A wood crasher comprising:

a body frame;

a crushing apparatus installed on said body frame and including a crushing rotor rotated in a crushing chamber;

a feed conveyor installed on one side of said body frame in the longitudinal direction thereof and including a drive wheel, a driven wheel, and a running member looped between said drive wheel and said driven wheel, thereby conveying woods to be crushed to said crushing apparatus;

a bottom-equipped hopper having side walls disposed on both sides of said feed conveyor in the transverse direction thereof, and a bottom wall disposed under said feed conveyor; and a guide member disposed in continuation with the bottom wall of said hopper at a position near said driven wheel of said feed conveyor to prevent wood pieces from accumulating near said driven wheel and to promote return of the wood pieces onto a conveying surface of said feed conveyor.

4. A wood crusher according to claim 3, wherein said guide member is formed substantially in a circular-arc shape to extend in proximity to a locus along which said driven wheel of said feed conveyor is rotated.

5. A wood crusher according to claim 3, wherein said guide member is slidable together with said driven wheel of said feed conveyor in the direction in which the woods to be crushed are conveyed by said feed conveyor.

6. A wood crusher according to claim 3, wherein said hopper is provided, in a rear end portion thereof, with an opening/closing section to which said guide member is attached.

* * * * *